US010156061B2

(12) United States Patent
Matsuyama et al.

(10) Patent No.: US 10,156,061 B2
(45) Date of Patent: Dec. 18, 2018

(54) WORK MACHINE CONTROL DEVICE, WORK MACHINE, AND WORK MACHINE CONTROL METHOD

(71) Applicant: Komatsu Ltd., Tokyo (JP)

(72) Inventors: Toru Matsuyama, Naka-gun (JP); Masashi Ichihara, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 112 days.

(21) Appl. No.: 15/114,538

(22) PCT Filed: Feb. 29, 2016

(86) PCT No.: PCT/JP2016/056144

§ 371 (c)(1),
(2) Date: Jul. 27, 2016

(87) PCT Pub. No.: WO2016/111384

PCT Pub. Date: Jul. 14, 2016

(65) Prior Publication Data

US 2017/0247861 A1 Aug. 31, 2017

(51) Int. Cl.

| | |
|---|---|
| ***E02F 9/00*** | (2006.01) |
| ***E02F 9/20*** | (2006.01) |
| ***E02F 3/43*** | (2006.01) |
| ***E02F 9/22*** | (2006.01) |
| ***E02F 9/26*** | (2006.01) |
| *E02F 3/32* | (2006.01) |

(52) U.S. Cl.

CPC ..... *E02F 9/2025* (2013.01); *E02F 3/435* (2013.01); *E02F 9/2207* (2013.01); *E02F 9/2292* (2013.01); *E02F 9/2296* (2013.01); *E02F 9/262* (2013.01); *E02F 3/32* (2013.01)

(58) Field of Classification Search

USPC ..... 701/50

See application file for complete search history.

(56) References Cited

U.S. PATENT DOCUMENTS 5,617,723 A * 4/1997 Hosseini ..... E02F 3/434 60/327
5,810,095 A * 9/1998 Orbach ..... A01B 63/1006 172/2
5,835,874 A * 11/1998 Hirata ..... E02F 3/435 701/50
8,977,444 B2 * 3/2015 Fukuhara ..... E02F 9/202 180/65.21

(Continued)

FOREIGN PATENT DOCUMENTS

JP 04-319127 A 11/1992
JP 05-272154 A 10/1993

(Continued)

OTHER PUBLICATIONS

International Search Report and Written Opinion dated May 24, 2016, issued for PCT/JP2016/056144.

*Primary Examiner* — Jonathan L Sample
(74) *Attorney, Agent, or Firm* — Locke Lord LLP

(57) ABSTRACT

A control device includes a control unit configured to change a change rate of a moving speed of a working unit of a work machine according to the moving speed of the working unit in a timing of switching between intervention control toward the working unit and control of the working unit based on an operation command from an operation device.

8 Claims, 10 Drawing Sheets

(56) References Cited

U.S. PATENT DOCUMENTS 9,885,168 B2 * 2/2018 Miyamoto ..... B60W 10/188
2008/0234902 A1 * 9/2008 Johnson ..... E02F 3/422 701/50
2008/0255735 A1 * 10/2008 Marathe ..... B60K 28/165 701/50
2009/0111655 A1 * 4/2009 Hatanaka ..... B60T 17/02 477/218
2009/0218112 A1 * 9/2009 Mintah ..... E02F 3/434 172/1
2009/0228177 A1 * 9/2009 Mintah ..... E02F 3/435 701/50
2012/0031088 A1 * 2/2012 Takebayashi ..... E02F 9/2225 60/452
2012/0310493 A1 * 12/2012 Fukuhara ..... E02F 9/202 701/50
2013/0268165 A1 * 10/2013 Hashima ..... B60W 10/30 701/50
2014/0095036 A1 * 4/2014 Hoff ..... B60W 10/11 701/65
2014/0199148 A1 * 7/2014 Imura ..... E02F 9/123 414/687
2015/0240939 A1 * 8/2015 Ge ..... F16H 61/0213 701/50
2015/0291399 A1 * 10/2015 Miki ..... B66C 13/063 182/19
2016/0024754 A1 * 1/2016 Miyamoto ..... E02F 9/2079 414/685
2016/0040394 A1 * 2/2016 Monden ..... B60W 20/20 414/685
2016/0069040 A1 * 3/2016 Kami ..... E02F 3/437 701/50
2016/0083931 A1 * 3/2016 Monden ..... B60L 7/14 701/50
2016/0097186 A1 * 4/2016 Yamada ..... B60K 6/365 701/50
2016/0130786 A1 * 5/2016 Miyamoto ..... E02F 9/2079 701/50
2016/0138240 A1 * 5/2016 Ikegami ..... E02F 9/2285 701/50
2016/0145836 A1 * 5/2016 Yamada ..... B60K 6/387 701/50
2016/0273194 A1 * 9/2016 Ikegami ..... E02F 3/435
2016/0281331 A1 * 9/2016 Ikegami ..... E02F 9/2228

FOREIGN PATENT DOCUMENTS

JP 2013-217137 A 10/2013
JP 5732598 A 6/2015
WO WO-95/30059 A1 11/1995

* cited by examiner

WORK MACHINE CONTROL DEVICE, WORK MACHINE, AND WORK MACHINE CONTROL METHOD

FIELD

The present invention relates to a work machine control device configured to control a work machine equipped with a working unit, a work machine, and a work machine control method.

BACKGROUND

In a construction machine having a front device including a bucket, control of moving the bucket along a boundary surface indicating a target shape of an construction object is proposed (for example, refer to Patent Literature 1). This control is referred to as intervention control.

CITATION LIST

Patent Literature

Patent Literature 1: WO 95/30059 A1

SUMMARY

Technical Problem

In intervention control, in a case where, for example, the target shape of the construction object is gone, or the like, execution of intervention control becomes unnecessary. Accordingly, execution of control of raising the working unit to prevent the working unit from undermining the target shape becomes unnecessary. In a case where this control becomes unnecessary during execution of control of raising the working unit, the working unit might suddenly fall. Accordingly, it would be practical to consider gradually releasing the control of raising the working unit. However, in a case where the control of raising the working unit is gradually released, the working unit might be raised depending on a rising speed of the working unit when execution of the control becomes unnecessary. This raising of the working unit might give a sense of discomfort to an operator.

In a case where an operator of a work machine is performing construction of a place where no target shape of a construction object exists by operating an operation device of the working unit, control of raising the working unit is executed when the working unit moves to where the target shape of the construction object exists. In a case where control of raising the working unit becomes necessary when the operator is executing operation of lowering the working unit, the working unit might be raised suddenly. Accordingly, it would be practical to consider gradually executing the control of raising the working unit. However, in a case where the control of raising the working unit is gradually executed, it might take time before the working unit changes from lowering to raising depending on the speed at which the working unit is lowered when this control becomes necessary. This might give a sense of discomfort to the operator.

An object in an aspect of the present invention is to suppress the sense of discomfort felt by the operator at the time of switching between the intervention control and the control of the working unit by operation of the operation device of the working unit.

Solution to Problem

According to a first aspect of the present invention, a work machine control device comprises a control unit configured to change a change rate of a moving speed of a working unit of a work machine according to the moving speed of the working unit in a timing of switching between intervention control toward the working unit and control of the working unit based on an operation command from an operation device.

According to a second aspect of the present invention, in the work machine control device according to the first aspect, the intervention control is control of raising the working unit, the moving speed of the working unit is a rising speed of the working unit, the timing of switching is a timing in which the intervention control becomes unnecessary, the work machine control device further comprises a determination unit configured to determine whether the rising speed is a threshold or above in the timing of switching, and in a case where the rising speed is the threshold or above, the control unit changes the rising speed such that a decrease rate of the rising speed is set to a value for a case where the rising speed in the timing of switching is the threshold, or to a higher value.

According to a third aspect of the present invention, in the work machine control device according to the second aspect, the control unit increases the decrease rate when the rising speed in the timing of switching is increased.

According to a fourth aspect of the present invention, in the work machine control device according to the third aspect, in a case where the rising speed in the timing of switching is below the threshold, the control unit sets the decrease rate to a predetermined value regardless of a magnitude of the rising speed at the timing of switching.

According to a fifth aspect of the present invention, in the work machine control device according to any one of the second to fourth aspects, in a case where the working unit is lowered by an operation command, the control unit sets a change rate of a lowering speed of the working unit to a predetermined value.

According to a sixth aspect of the present invention, in the work machine control device according to any one of the second to fifth aspects, the work machine includes a swing body equipped with the working unit.

According to a seventh aspect of the present invention, a work machine comprises the work machine control device according to any one of the first to sixth aspects.

According to a eighth aspect of the present invention, a control method for a work machine, the control method comprises changing a change rate of a moving speed of a working unit of the work machine according to the moving speed of the working unit in a timing of switching between intervention control toward the working unit and control of the working unit based on an operation command from an operation device.

According to an aspect of the present invention, it is possible to suppress the sense of discomfort felt by the operator at the time of switching between the intervention control and the control of the working unit by operation of an operation device of the working unit.

DESCRIPTION OF EMBODIMENTS

Embodiments of the present invention will be described in detail with reference to the drawings.

<Overall Configuration of Work Machine>

Figure 1:
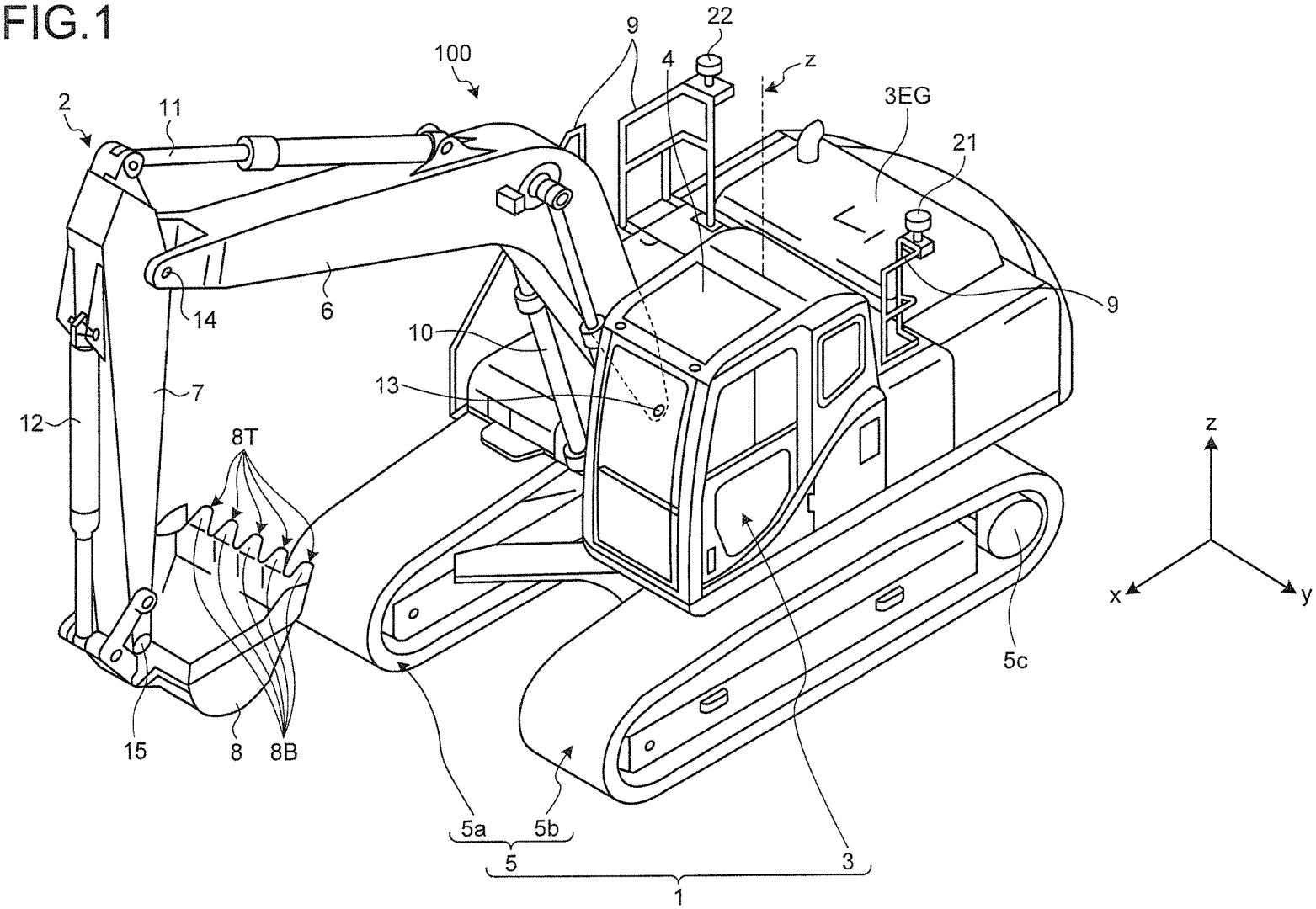
FIG. 1 is a perspective view of a work machine according to an embodiment.
Figure 2:
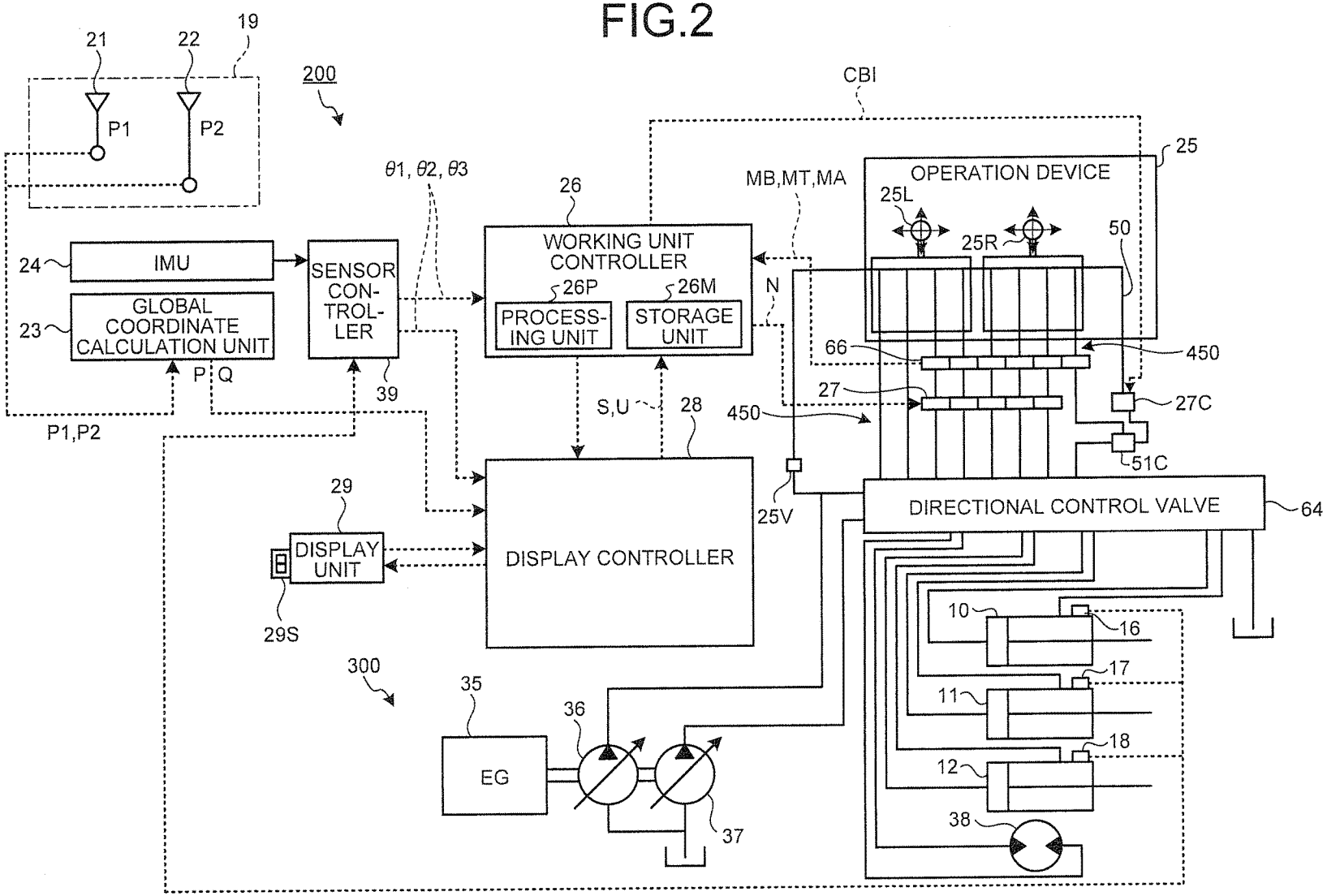
FIG. 2 is a block diagram illustrating a configuration of a control system and a hydraulic system of an excavator.

FIG. 1 is a perspective view of a work machine according to an embodiment. FIG. 2 is a block diagram illustrating a configuration of a control system 200 and a hydraulic system 300 of an excavator 100. The excavator 100 as a work machine includes a vehicle main body 1 and a working unit 2. The vehicle main body 1 includes an upper swing body 3 as a swing body and a traveling device 5 as a traveling body. The upper swing body 3 houses, inside an engine room 3EG, devices such as an internal combustion engine as a power generator and a hydraulic pump. The engine room 3EG is arranged on one end side of the upper swing body 3.

In an embodiment, the excavator 100 uses, for example, a diesel engine as the internal combustion engine as a power generator, although the power generator is not limited to this. The power generator of the excavator 100 may be a hybrid device combining, for example, an internal combustion engine, a generator motor, and a storage battery device. Alternatively, the power generator of the excavator 100 may be a combination of a storage battery device and a generator motor, without using an internal combustion engine.

The upper swing body 3 includes an operator cab 4. The operator cab 4 is arranged on another end side of the upper swing body 3. This means the operator cab 4 is arranged on an opposite side of where the engine room 3EG is arranged. Inside the operator cab 4, a display unit 29 and an operation device 25, illustrated in FIG. 2, are arranged. A handrail 9 is attached above the upper swing body 3.

The traveling device 5 includes the upper swing body 3. The traveling device 5 includes crawlers 5*a* and 5*b*. The traveling device 5 allows the excavator 100 to travel by causing one or both of traveling motors 5*c* provided on both left and right sides to drive and rotate the crawlers 5*a* and 5*b*. The working unit 2 is attached on a side of the operator cab 4 of the upper swing body 3.

The excavator 100 may include tires instead of the crawlers 5*a* and 5*b* and a traveling device capable of traveling by transmitting a drive power of an engine to the tires via a transmission. Examples of the excavator 100 having this form include a wheel-type excavator. Alternatively, the excavator 100 may be, for example, a backhoe loader.

On the upper swing body 3, a side on which the working unit 2 and the operator cab 4 are arranged is defined as a front, and a side on which the engine room 3EG is arranged is defined as a back. A left side in a direction toward the front is defined as left of the upper swing body 3, and a right side in a direction toward the front is defined as right of the upper swing body 3. A left-right direction of the upper swing body 3 is also referred to as a width direction. On the excavator 100 or the vehicle main body 1, a side on which the traveling device 5 exists is defined as a bottom with reference to the upper swing body 3, and a side on which the upper swing body 3 exists is defined as a top with reference to the traveling device 5. With respect to the excavator 100, a front-back direction is defined as an x-direction, a width direction is defined as a y-direction, and an up-down direction is defined as a z-direction. In a case where the excavator 100 is installed on a horizontal surface, the bottom indicates the vertical direction, namely, a direction of action of gravity, and the top indicates the opposite direction of the vertical direction.

The working unit 2 includes a boom 6, an arm 7, a bucket 8 as a working tool, a boom cylinder 10, an arm cylinder 11, and a bucket cylinder 12. A proximal end of the boom 6 is attached to a front portion of the vehicle main body 1 via a boom pin 13. A proximal end of the arm 7 is attached to a distal end of the boom 6 via an arm pin 14. At the distal end of the arm 7, the bucket 8 is attached via a bucket pin 15. The bucket 8 moves around the bucket pin 15 as a center. On the bucket 8, a plurality of blades 8B is attached on an opposite side of the bucket pin 15. A blade edge 8T is an edge of the blade 8B.

In an embodiment, rising operation of the working unit 2 is defined as operation whereby the working unit 2 moves in a direction from a ground contact surface of the excavator 100 toward the upper swing body 3. Lowering operation of the working unit 2 is defined as operation whereby the working unit 2 moves in a direction from the upper swing body 3 of the excavator 100 toward the ground contact surface. The ground contact surface of the excavator 100 is a plane defined by at least three points in grounding portions of the crawlers 5*a* and 5*b*. The at least three points used for defining the ground contact surface may be included in one or both of the two crawlers 5*a* and 5*b*.

In a case where the work machine does not include the upper swing body 3, rising operation of the working unit 2 is defined as operation whereby the working unit 2 moves in a direction of separating from the ground contact surface of the work machine. Lowering operation of the working unit 2 is defined as operation whereby the working unit 2 moves in a direction of approaching the ground contact surface of the work machine. In a case where the work machine includes wheels instead of crawlers, the ground contact surface is a plane defined by a portion where at least three wheels contact the ground.

The bucket 8 need not include the plurality of blades 8B. Specifically, the bucket 8 need not include blades 8B illustrated in FIG. 1 but may have a blade edge being formed into a straight shape using a steel plate. The working unit 2 may include, for example, a tilt bucket having a single blade. The tilt bucket is a bucket including a bucket tilt cylinder. By tilting operation of the bucket in the left-right directions, the tilt bucket is capable of freely forming and grading inclined and flat places, and capable of performing compaction work using a bottom plate, even when the excavator is located in an inclined place. Alternatively, the working unit 2 may include, instead of the bucket 8, a slope-land bucket, or a drilling attachment with a drilling tip as a working tool.

Each of the boom cylinder 10, the arm cylinder 11, and the bucket cylinder 12, illustrated in FIG. 1, is a hydraulic cylinder driven by a pressure of hydraulic oil (hereinafter, referred to as a hydraulic pressure). The boom cylinder 10 drives the boom 6 to be raised or to be lowered. The arm cylinder 11 drives the arm 7 to operate around the arm pin 14. The bucket cylinder 12 drives the bucket 8 to operate around the bucket pin 15.

Between the hydraulic cylinders including the boom cylinder 10, the arm cylinder 11, and the bucket cylinder 12, and hydraulic pumps 36 and 37 illustrated in FIG. 2, a directional control valve 64 illustrated in FIG. 2 is provided. The directional control valve 64 controls a flow rate of the hydraulic oil supplied from the hydraulic pumps 36 and 37 to the boom cylinder 10, the arm cylinder 11, and the bucket cylinder 12, or the like, and switches a flowing direction of the hydraulic oil. The directional control valve 64 includes a directional control valve for travel, configured to drive the traveling motor 5*c* and includes a directional control valve for a working unit, configured to control a swing motor that swings the boom cylinder 10, the arm cylinder 11, the bucket cylinder 12, and the upper swing body 3.

By operation of a working unit controller 26 illustrated in FIG. 2 to control a control valve 27 illustrated in FIG. 2, a pilot pressure of the hydraulic oil supplied from the operation device 25 to the directional control valve 64 is controlled. The control valve 27 is provided in a hydraulic system of each of the boom cylinder 10, the arm cylinder 11, and the bucket cylinder 11. The working unit controller 26 can control operation of the boom cylinder 10, the arm cylinder 11 and the bucket cylinder 12 by controlling the control valve 27 provided in a pilot oil path 450. In an embodiment, the working unit controller 26 can execute control of decelerating the boom cylinder 10, the arm cylinder 11, and the bucket cylinder 12 by executing control of closing the control valve 27.

On an upper portion of the upper swing body 3, antennas 21 and 22 are attached. The antennas 21 and 22 are used to detect a current position of the excavator 100. The antennas 21 and 22 are electrically connected with a position detection device 19, namely, a position detection unit configured to detect the current position of the excavator 100, as illustrated in FIG. 2.

The position detection device 19 detects the current position of the excavator 100 using real time kinematic—global navigation satellite systems (RTK-GNSS). Hereinafter, the antennas 21 and 22 will be referred to as GNSS antennas 21 and 22, as appropriate. A signal corresponding to GNSS radio waves received by the GNSS antennas 21 and 22 is input into the position detection device 19. The position detection device 19 detects an installation position of the GNSS antennas 21 and 22. The position detection device 19 includes, for example, a three-dimensional position sensor.

<Hydraulic System 300>

As illustrated in FIG. 2, a hydraulic system 300 of the excavator 100 includes an internal combustion engine 35 as a power generation source, and the hydraulic pumps 36 and 37. The hydraulic pumps 36 and 37 are driven by the internal combustion engine 35 and emit hydraulic oil. The hydraulic oil emitted from the hydraulic pumps 36 and 37 is supplied to the boom cylinder 10, the arm cylinder 11, and the bucket cylinder 12.

The excavator 100 includes a swing motor 38. The swing motor 38 is a hydraulic motor and driven by the hydraulic oil emitted from the hydraulic pumps 36 and 37. The swing motor 38 causes the upper swing body 3 to swing. Although two hydraulic pumps 36 and 37 are illustrated in FIG. 2, the number of hydraulic pumps provided may be one. The swing motor 38 is not limited to the hydraulic motor but may be an electric motor.

<Control System 200>

A control system 200 as a control system of the work machine includes the position detection device 19, a global coordinate calculation unit 23, the operation device 25, the working unit controller 26 as a work machine control device according to an embodiment, a sensor controller 39, a display controller 28, and the display unit 29. The operation device 25 is a device used to operate the working unit 2 and the upper swing body 3, illustrated in FIG. 1. The operation device 25 is a device used to operate the working unit 2. The operation device 25 receives operation by an operator in order to drive the working unit 2 and outputs a pilot hydraulic pressure corresponding to an operation amount.

The pilot hydraulic pressure corresponding to the operation amount is an operation command. The operation command is a command used to cause the working unit 2 to operate. The operation command is generated by the operation device 25. The operation device 25 is operated by an operator, and thus, the operation command is a command used for manual operation, namely, a command to cause the working unit 2 to operate by operation by the operator. Control of the working unit 2 with manual operation corresponds to control of the working unit 2 based on the operation command from the operation device 25, namely, corresponds to control of the working unit 2 by operation of the operation device 25 of the working unit 2.

In an embodiment, the operation device 25 includes a left operation lever 25L installed on a left side of the operator and a right operation lever 25R installed on a right side of the operator. Front-back and left-right operation of the left operation lever 25L and the right operation lever 25R corresponds to two axis operation of the arm 7 and swing operation. For example, operation of the right operation lever 25R in a front-back direction corresponds to operation of the boom 6. When the right operation lever 25R is operated forwardly, the boom 6 is lowered. When the right operation lever 25R is operated backwardly, the boom 6 is raised. Raising and lowering operation of the boom 6 is executed in response to the operation in the front-back direction. Operation of the right operation lever 25R in a left-right direction corresponds to operation of the bucket 8. When the right operation lever 25R is operated leftwardly, the bucket 8 performs excavation. When the right operation lever 25R is operated rightwardly, the bucket 8 performs dumping. Excavation or opening operation of the bucket 8 is executed in response to operation in the left-right direction. Operation of the left operation lever 25L in the front-back direction corresponds to swing of the arm 7. When the left operation lever 25L is operated forwardly, the arm 7 performs dumping. When the left operation lever 25L is operated backwardly, the arm 7 performs excavation. Operation of the left operation lever 25L in the left-right direction corresponds to swing of the upper swing body 3. When the left operation lever 25L is operated leftwardly, the upper swing body 3 swings to the left. When the left operation lever 25L is operated rightwardly, the upper swing body 3 swings to the right.

In an embodiment, the operation device 25 uses a pilot hydraulic pressure system. Hydraulic oil is decompressed to a predetermined pilot pressure by a decompression valve 25V, and the decompressed hydraulic oil is supplied from the hydraulic pump 36 to the operation device 25 based on boom operation, bucket operation, arm operation, and swing operation.

Supply of pilot hydraulic pressure to the pilot oil path 450 is enabled in response to operation of the right operation lever 25R in the front-back direction, and operation of the boom 6 by the operator is accepted. A valve device included in the right operation lever 25R opens in response to the operation amount of the right operation lever 25R, and hydraulic oil is supplied to the pilot oil path 450. A pressure sensor 66 detects a pressure of the hydraulic oil inside the pilot oil path 450 at that time, as a pilot pressure. The pressure sensor 66 transmits the detected pilot pressure to the working unit controller 26 as a boom operation amount MB. Hereinafter, the operation amount of the right operation lever 25R in the front-back direction will be referred to as the boom operation amount MB, as appropriate. In a pilot oil path 50, a control value (hereinafter, referred to as an intervention valve as appropriate) 27C and a shuttle valve 51 are provided. The intervention valve 27C and the shuttle valve 51 will be described below.

Supply of pilot hydraulic pressure to the pilot oil path 450 is enabled in response to the operation of the right operation lever 25R in the left-right direction, and operation of the bucket 8 by the operator is accepted. The valve device included in the right operation lever 25R opens in response to the operation amount of the right operation lever 25R, and hydraulic oil is supplied to the pilot oil path 450. The pressure sensor 66 detects a pressure of the hydraulic oil inside the pilot oil path 450 at that time, as a pilot pressure. The pressure sensor 66 transmits the detected pilot pressure to the working unit controller 26 as a bucket operation amount MT. Hereinafter, the operation amount of the right operation lever 25R in the left-right direction will be referred to as the bucket operation amount MT, as appropriate.

Supply of pilot hydraulic pressure to the pilot oil path 450 is enabled in response to operation of the left operation lever 25L in the front-back direction, and operation of the arm 7 by the operator is accepted. A valve device included in the left operation lever 25L opens in response to the operation amount of the left operation lever 25L, and hydraulic oil is supplied to the pilot oil path 450. The pressure sensor 66 detects a pressure of the hydraulic oil inside the pilot oil path 450 at that time, as a pilot pressure. The pressure sensor 66 transmits the detected pilot pressure to the working unit controller 26 as an arm operation amount MA. Hereinafter, the operation amount of the left operation lever 25L in the left-right direction will be referred to as the arm operation amount MA, as appropriate.

With operation of the right operation lever 25R, the operation device 25 supplies a pilot hydraulic pressure with a magnitude that corresponds to the operation amount of the right operation lever 25R to the directional control valve 64. With operation of the left operation lever 25L, the operation device 25 supplies a pilot hydraulic pressure with a magnitude that corresponds to the operation amount of the left operation lever 25L to the directional control valve 64. The directional control valve 64 operates by the pilot hydraulic pressure supplied from the operation device 25 to the directional control valve 64.

The control system 200 includes a first stroke sensor 16, a second stroke sensor 17, and a third stroke sensor 18. For example, the first stroke sensor 16 is provided on the boom cylinder 10, the second stroke sensor 17 is provided on the arm cylinder 11, and the third stroke sensor 18 is provided on the bucket cylinder 12.

The sensor controller 39 includes a storage unit such as a random access memory (RAM) and a read only memory (ROM), and a processing unit such as a central processing unit (CPU). Based on a boom cylinder length LS1 detected by the first stroke sensor 16, the sensor controller 39 calculates an inclination angle θ1 of the boom 6 with respect to a direction (z-direction) orthogonal to a horizontal surface (xy plane) on a local coordinate system of the excavator 100, specifically, on a local coordinate system of the vehicle main body 1, and outputs the inclination angle θ1 to the working unit controller 26 and the display controller 28. Based on an arm cylinder length LS2 detected by the second stroke sensor 17, the sensor controller 39 calculates an inclination angle θ2 of the arm 7 with respect to the boom 6 and outputs the inclination angle θ2 to the working unit controller 26 and the display controller 28. Based on a bucket cylinder length LS3 detected by the third stroke sensor 18, the sensor controller 39 calculates an inclination angle θ3 of the blade edge 8T of the bucket 8, provided on the bucket 8, with respect to the arm 7, and outputs the inclination angle θ3 to the working unit controller 26 and the display controller 28. Inclination angles θ1, θ2, and θ3 can be detected by other sensors besides the first stroke sensor 16, the second stroke sensor 17, and the third stroke sensor 18. For example, angle sensors such as a potentiometer can also detect the inclination angles θ1, θ2, and θ3.

The sensor controller 39 is connected with an inertial measurement unit (IMU) 24. The IMU 24 obtains information regarding inclination of a vehicle body, such as pitch around the y-axis, and a roll around the x-axis, of the excavator 100, illustrated in FIG. 1, and outputs the information to the sensor controller 39.

The working unit controller 26 includes a storage unit 26M such as a RAM and a read only memory (ROM) and a processing unit 26P such as a CPU. The working unit controller 26 controls the intervention valve 27C and the control valve 27 based on the boom operation amount MB, the bucket operation amount MT, and the arm operation amount MA, illustrated in FIG. 2.

The directional control valve 64 illustrated in FIG. 2 is, for example, a proportional control valve, and controlled by hydraulic oil supplied from the operation device 25. The directional control valve 64 is arranged between hydraulic actuators and the hydraulic pumps 36 and 37. Examples of the hydraulic actuators include the boom cylinder 10, the arm cylinder 11, the bucket cylinder 12, and the swing motor 38. The directional control valve 64 controls the flow rate and direction of the hydraulic oil supplied from the hydraulic pumps 36 and 37 to the boom cylinder 10, the arm cylinder 11, the bucket cylinder 12, and the swing motor 38.

The position detection device 19 provided on the control system 200 includes the above described GNSS antennas 21 and 22. A signal corresponding to GNSS radio waves received by the GNSS antennas 21 and 22 is input into the global coordinate calculation unit 23. The GNSS antenna 21 receives reference position data P1 indicating an own position, from a positioning satellite. The GNSS antenna 22 receives reference position data P2 indicating an own position, from a positioning satellite. The GNSS antennas 21 and 22 receive reference position data P1 and P2 in predetermined cycles. The reference position data P1 and P2 are information on a position at which the GNSS antenna is installed. Each time the reference position data P1 and P2 are received by the GNSS antennas 21 and 22, the GNSS antennas 21 and 22 output the data to the global coordinate calculation unit 23.

The global coordinate calculation unit 23 includes a storage unit such as a RAM and a ROM, and a processing unit such as a CPU. Based on the reference position data P1 and P2, the global coordinate calculation unit 23 generates swing body arrangement data indicating arrangement of the upper swing body 3. In the present embodiment, the swing body arrangement data includes the reference position data P, namely, one of the reference position data P1 and P2, and swing body orientation data Q generated based on the reference position data P1 and P2. The swing body orientation data Q indicates orientation of the upper swing body 3, namely, orientation of the working unit 2. Each time the reference position data P1 and P2 are obtained from the GNSS antennas 21 and 22 in a predetermined cycle, the global coordinate calculation unit 23 updates the swing body arrangement data, namely, the reference position data P and the swing body orientation data Q, and outputs the updated data to the display controller 28.

The display controller 28 includes a storage unit such as a RAM and a ROM, and a processing unit such as a CPU. The display controller 28 obtains the reference position data P and the swing body orientation data Q, as swing body arrangement data, from the global coordinate calculation unit 23. In an embodiment, the display controller 28 generates bucket blade edge position data S indicating a three-dimensional position of the blade edge 8T of the bucket 8, as working unit position data. Subsequently, the display controller 28 generates target excavation terrain data U using the bucket blade edge position data S and target construction information T.

The target construction information T is information representing a target state of finish of a work object, or of an excavation object in an embodiment, of the working unit 2 included in the excavator 100. The target construction information T includes, for example, design information on a construction object of the excavator 100. An exemplary work object of the working unit 2 is a ground. Examples of works of the working unit 2 may include but are not limited to excavation work and ground leveling work.

The display controller 28 calculates target excavation terrain data Ua for display based on the target excavation terrain data U. Based on the target excavation terrain data Ua for display, the display controller 28 allows a target shape, e.g., terrain, of the work object of the working unit 2 to be displayed on the display unit 29.

The display unit 29 may include but is not limited to a liquid crystal display device that receives input from a touch panel. In an embodiment, a switch 29S is installed adjacent to the display unit 29. The switch 29S is an input device used to execute intervention control described below and to stop intervention control in execution.

The working unit controller 26 obtains, from the pressure sensor 66, the boom operation amount MB, the bucket operation amount MT, and the arm operation amount MA. The working unit controller 26 obtains, from the sensor controller 39, the inclination angle θ1 of the boom 6, the inclination angle θ2 of the arm 7, and the inclination angle θ3 of the bucket 8.

The working unit controller 26 obtains the target excavation terrain data U from the display controller 28. The target excavation terrain data U is information on a range in which the excavator 100 is scheduled to work, among the target construction information T. That is, the target excavation terrain data U is part of the target construction information T. Accordingly, the target excavation terrain data U, similarly to the target construction information T, indicates a shape indicating a target state of finish of the work object of the working unit 2. Hereinafter, the shape indicating a target state of finish will be referred to as target excavation terrain, as appropriate.

The working unit controller 26 calculates a position (hereinafter, referred to as a blade edge position as appropriate) of the blade edge 8T of the bucket 8 based on the angles of the working unit 2 obtained from the sensor controller 39. The working unit controller 26 controls operation of the working unit 2 such that the blade edge 8T of the bucket 8 moves along the target excavation terrain data U based on a distance between the target excavation terrain data U and the blade edge 8T of the bucket 8, and based on a speed of the working unit 2. In this case, the working unit controller 26 controls such that the speed in the direction that the working unit 2 approaches a construction object is a limit speed or below. This control of speed is performed to suppress undermining of the shape of the target excavation terrain data U, namely, a target shape of the work object of the working unit 2, by the bucket 8. This control is referred to as intervention control, as appropriate. Intervention control is executed when, for example, an operator of the excavator 100 has selected execution of intervention control using the switch 29S illustrated in FIG. 2. In calculation of the distance between the target excavation terrain and the bucket 8 as described below, a reference position of the bucket 8 is not limited to the blade edge 8T but may be arbitrarily determined.

In intervention control, in order to control the working unit 2 such that the blade edge 8T of the bucket 8 moves along the target excavation terrain data U, the working unit controller 26 generates a boom command signal CBI and outputs the signal to the intervention valve 2/C illustrated in FIG. 2. The boom 6 operates in response to the boom command signal CBI. Accordingly, the speed of the working unit 2, more specifically, the bucket 8, in approaching the target excavation terrain data U is limited according to the distance between the bucket 8 and the target excavation terrain data U.

Figure 3:
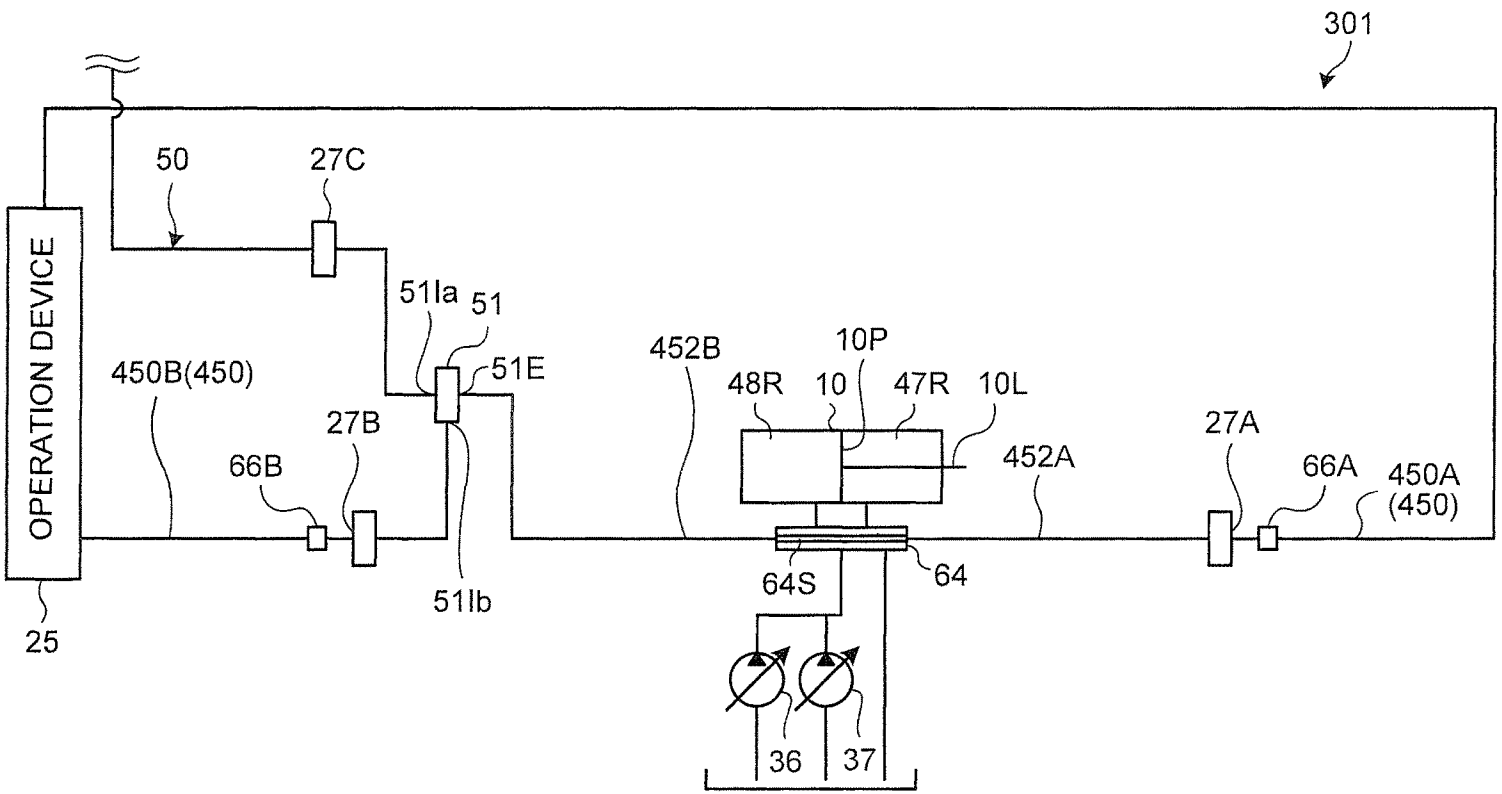
FIG. 3 is a diagram illustrating an exemplary hydraulic circuit of a boom cylinder.

FIG. 3 is a diagram illustrating an exemplary hydraulic circuit 301 of the boom cylinder 10. In the hydraulic circuit 301, the pilot oil path 450 is provided between the operation device 25 and the directional control valve 64. The directional control valve 64 is a valve to control a flowing direction of the hydraulic oil supplied to the boom cylinder 10. In an embodiment, the directional control valve 64 is a spool-type valve, which switches a flowing direction of the hydraulic oil by moving a rod-shaped spool 64S. The spool 64S moves by the hydraulic oil supplied from the operation device 25 illustrated in FIG. 2. The directional control valve 64 supplies the hydraulic oil (hereinafter, referred to pilot oil as appropriate) to the boom cylinder 10 along with movement of the spool 64S, thereby causing the boom cylinder 10 to operate.

The pilot oil path 50 and a pilot oil path 450B are connected with the shuttle valve 51. The shuttle valve 51 is connected with one end of the directional control valve 64 via an oil path 452B. The other end of the directional control valve 64 is connected with the operation device 25 via a pilot oil path 450A. The intervention valve 27C is provided in the pilot oil path 50. The intervention valve 27C adjusts a pilot pressure of the pilot oil path 50.

A pressure sensor 66B and a control valve 27B are provided in the pilot oil path 450B. In the pilot oil path 450A, a pressure sensor 66A is provided between a control valve 27A and the operation device 25. A detection value of the pressure sensor 66 is obtained by the working unit controller 26 illustrated in FIG. 2 and used to control the boom cylinder 10. The pressure sensor 66B corresponds to the pressure sensor 66 illustrated in FIG. 2. A pressure sensor corresponding to the pressure sensor 66A is omitted in FIG. 2. The control valve 27B corresponds to the control valve 27 illustrated in FIG. 2. A control valve corresponding to the control valve 27A is omitted in FIG. 2.

The hydraulic oil supplied from the hydraulic pumps 36 and 37 is supplied to the boom cylinder 10 via the directional control valve 64. By a movement of the spool 64S in an axial direction, supply of the hydraulic oil to the boom cylinder 10 is switched between supply toward a cap-side oil chamber 48R and supply toward a rod-side oil chamber 47R. By the movement of the spool 64S in the axial direction, the amount of hydraulic oil supply, namely, the flow rate, toward the boom cylinder 10 per unit time is adjusted. An operation speed of the boom cylinder 10 is adjusted according to the adjusted flow rate of the hydraulic oil toward the boom cylinder 10.

When the spool 64S of the directional control valve 64 moves in a first direction, hydraulic oil is supplied from the directional control valve 64 to the cap-side oil chamber 48R. When the hydraulic oil returns from the rod-side oil chamber 47R to the directional control valve 64, a piston 10P of the boom cylinder 10 moves from the cap-side oil chamber 48R to the rod-side oil chamber 47R. As a result, a rod 10L connected to the piston 10P extends from the boom cylinder 10.

When the spool 64S of the directional control valve 64 moves in a second direction, that is an opposite direction of the first direction, based on a command from the operation device 25, hydraulic oil is returned from the cap-side oil chamber 48R to the directional control valve 64. When the hydraulic oil is supplied from the directional control valve 64 to the rod-side oil chamber 47R, the piston 10P of the boom cylinder 10 moves from the rod-side oil chamber 47R to the cap-side oil chamber 48R. As a result, the rod 10L connected to the piston 10P is retracted to the boom cylinder 10. In this manner, the operation direction of the boom cylinder 10 is changed according to the adjustment of the movement direction of the spool 64S of the directional control valve 64. Adjustment of the amount of movement of the spool 64S of the directional control valve 64 would change the flow rate of the hydraulic oil supplied to the boom cylinder 10 and returned from the boom cylinder 10 to the directional control valve 64. Accordingly, the operation speed of the boom cylinder 10, namely, the moving speeds of the piston 10P and the rod 10L are changed.

As described above, operation of the directional control valve 64 is controlled by the operation device 25. The hydraulic oil emitted from the hydraulic pump 36 and then decompressed by the decompression valve 25V, illustrated in FIG. 2, is supplied to the operation device 25 as pilot oil. The operation device 25 adjusts a pilot hydraulic pressure based on operation of each of operation levers. The directional control valve 64 is driven by the adjusted pilot hydraulic pressure. The magnitude and the direction of the pilot hydraulic pressure are adjusted by the operation device 25, and accordingly, the amount of movement and the movement direction of the spool 64S related to the axial direction are adjusted. As a result, the operation speed and the operation direction of the boom cylinder 10 are changed.

Based on the target excavation terrain (target excavation terrain data U) indicating the designed terrain as a target shape of the excavation object and based on the inclination angles 91, 02, and 93 used to obtain the position of the bucket 8, the working unit controller 26, in intervention control as described above, limits the speed of the boom 6 such that the speed at which the bucket 8 approaches target excavation terrain 43I decreases according to a distance between the target excavation terrain 43I and the bucket 8.

In an embodiment, in a case where the working unit 2 operates based on operation of the operation device 25, the working unit controller 26 generates a boom command signal CBI and controls operation of the boom 6 using this signal so as not to allow the blade edge 8T of the bucket 8 to undermine the target excavation terrain 43I. Specifically, the working unit controller 26 raises the boom 6 so as not to allow, in intervention control, the blade edge 8T to undermine the target excavation terrain 43I. The control of raising the boom 6 executed in intervention control will be referred to as boom intervention control as appropriate.

In the present embodiment, in order to achieve boom intervention control by the working unit controller 26, the working unit controller 26 generates a boom command signal CBI related to boom intervention control and outputs the signal to the intervention valve 27C. The intervention valve 27C can adjust the pilot hydraulic pressure of the pilot oil path 50. The shuttle valve 51 includes two inlets 51Ia and 51Ib, and an outlet 51E. One of the inlets, namely, the inlet 51Ia is connected with the intervention valve 27C. The other inlet, namely, the inlet 51Ib is connected with the control valve 27B. An outlet 51IE is connected with the oil path 452B connected with the directional control valve 64.

The shuttle valve 51 connects the oil path 452B with one with higher pilot hydraulic pressure, of the two inlets 51Ia and 51Ib. For example, in a case where the pilot hydraulic pressure at the inlet 51Ia is higher than the pilot hydraulic pressure at the inlet 51Ib, the shuttle valve 51 connects the intervention valve 27C with the oil path 452B. As a result, the pilot oil that has passed through the intervention valve 27C is supplied to the oil path 452B via the shuttle valve 51. In a case where the pilot hydraulic pressure at the inlet 51Ib is higher than the pilot hydraulic pressure at the inlet 51Ia, the shuttle valve 51 connects the control valve 27B with the oil path 452B. As a result, the pilot oil that has passed through the control valve 27B is supplied to the oil path 452B via the shuttle valve 51.

When the boom intervention control is not executed, the directional control valve 64 is driven based on the pilot hydraulic pressure adjusted by operation of the operation device 25. For example, the working unit controller 26 controls the control valve 27B to open (fully open) a pilot oil path 451B, and together with this, controls the intervention valve 27C to close the pilot oil path 50, such that the directional control valve 64 is driven based on the pilot hydraulic pressure adjusted by operation of the operation device 25.

When the boom intervention control is executed, the working unit controller 26 controls the control valve 27 such that the directional control valve 64 is driven based on the pilot hydraulic pressure adjusted by the intervention valve 27C. For example, when executing intervention control, namely, control of limiting the movement of the bucket 8 to the target excavation terrain 43I, the working unit controller 26 controls the intervention valve 27C such that the pilot hydraulic pressure of the pilot oil path 50 adjusted by the intervention valve 27C becomes higher than the pilot hydraulic pressure of the pilot oil path 451B adjusted by the operation device 25. With this control, the pilot oil from the intervention valve 27C is supplied to the directional control valve 64 via the shuttle valve 51.

The working unit controller 26 when it executes intervention control, generates, for example, a boom command signal CBI as a speed command to raise the boom 6 and controls the intervention valve 27C. With this control, the directional control valve 64 of the boom cylinder 10 supplies hydraulic oil to the boom cylinder 10 such that the boom 6 is raised at a speed corresponding to the boom command signal CBI, whereby the boom cylinder 10 raises the boom 6.

The hydraulic circuit 301 of the boom cylinder 10 has been described. Each of the hydraulic circuit of the arm cylinder 11 and the hydraulic circuit of the bucket cylinder 12 has a configuration corresponding to a configuration of the hydraulic circuit 301 of the boom cylinder 10 excluding the intervention valve 27C, the shuttle valve 51 and the pilot oil path 50.

The boom intervention control is control of raising the boom 6 executed in intervention control. In intervention control, the working unit controller 26 may be configured to raise at least one of the arm 7 and the bucket 8 in addition to raising the boom 6, or instead of raising the boom 6. Specifically, in the intervention control, the working unit controller 26 moves the working unit 2 in a direction of separating from the target shape of the work object of the working unit 2, that is, separating from the target excavation terrain 43I in an embodiment, by raising at least one of the boom 6, the arm 7, and the bucket 8, included in the working unit 2.

In an embodiment, in a case where the working unit 2 operates based on operation of the operation device 25, control by the working unit controller 26 to cause at least one of the boom 6, the arm 7, and the bucket 8, included in the working unit 2, to operate, is referred to as intervention control. In other words, intervention control is control whereby the working unit controller 26 causes the working unit to operate in a case where the working unit 2 operates based on operation of the operation device 25, namely, based on manual operation. The above-described boom intervention control is an aspect of intervention control.

Figure 4:
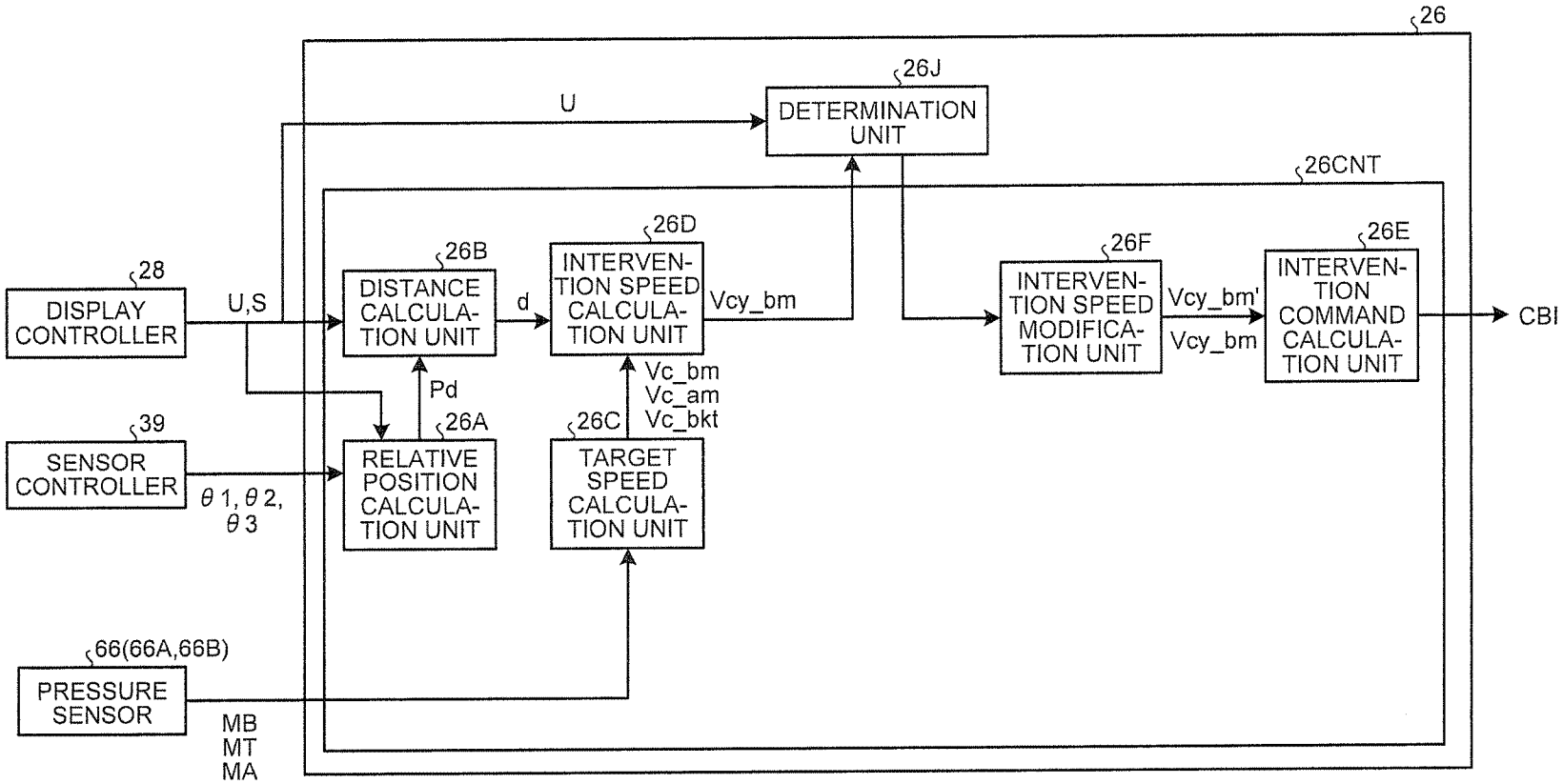
FIG. 4 is a block diagram of a working unit controller.
Figure 5:
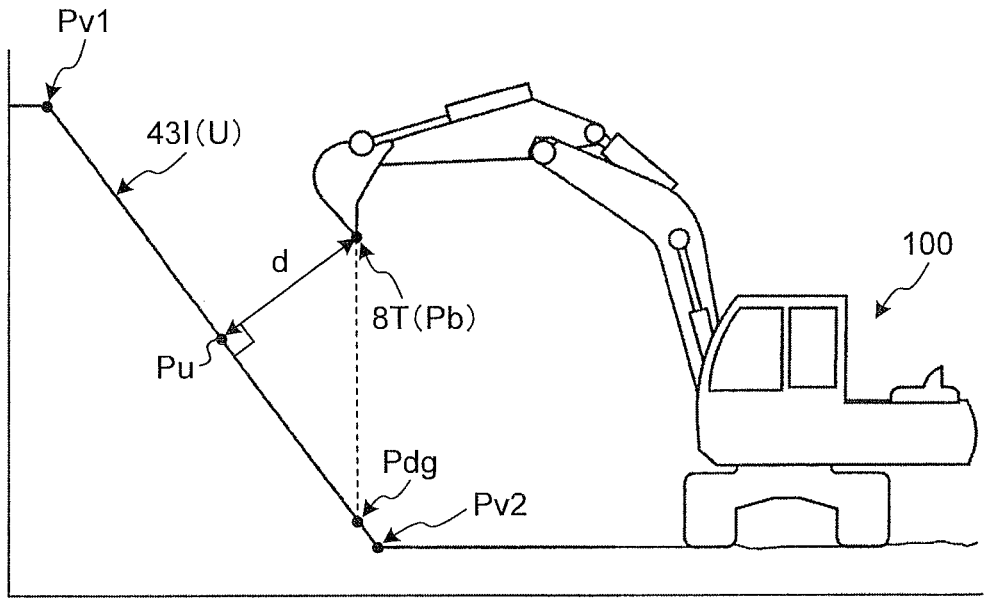
FIG. 5 is a diagram for illustrating target excavation terrain data and a bucket.
Figure 6:
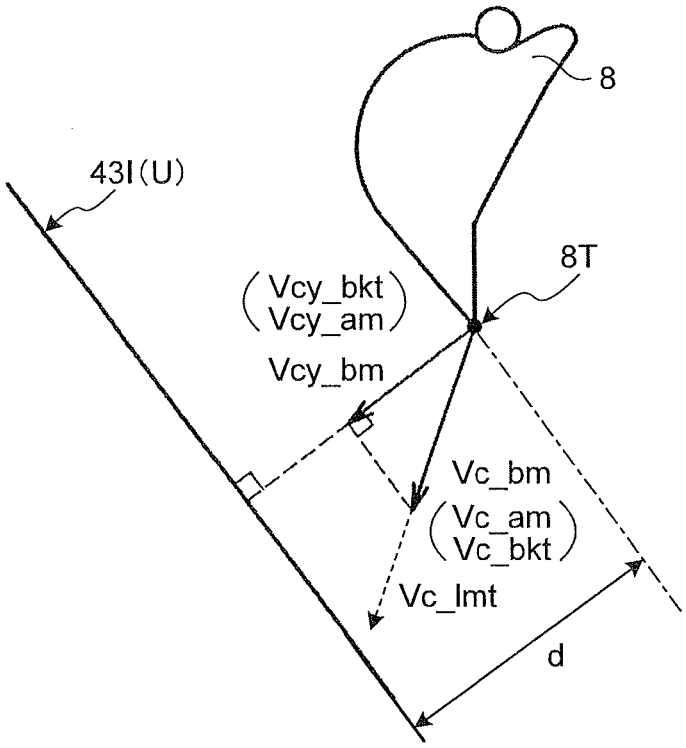
FIG. 6 is a diagram for illustrating a boom limit speed.
Figure 7:
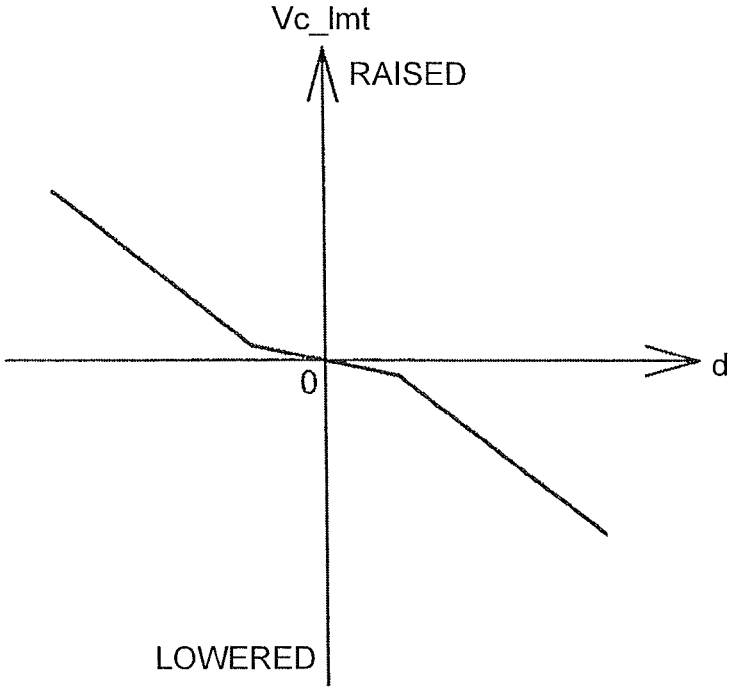
FIG. 7 is a diagram for illustrating a limit speed.

FIG. 4 is a block diagram of the working unit controller 26. FIG. 5 is a diagram for illustrating the target excavation terrain data U and the bucket 8. FIG. 6 is a diagram for illustrating a boom limit speed Vcy_bm. FIG. 7 is a diagram for illustrating a limit speed Vc_lmt. The working unit controller 26 includes a determination unit 26J and a control unit 26CNT. The control unit 26CNT includes a relative position calculation unit 26A, a distance calculation unit 26B, a target speed calculation unit 26C, an intervention speed calculation unit 26D, an intervention command calculation unit 26E, and an intervention speed modification unit 26F. Functions of the determination unit 26J, the relative position calculation unit 26A, the distance calculation unit 26B, the target speed calculation unit 26C, the intervention speed calculation unit 26D, and the intervention command calculation unit 26E are achieved by the processing unit 26P of the working unit controller 26, illustrated in FIG. 2.

In execution of intervention control, the working unit controller 26 generates a boom command signal CBI required for intervention control, by using the boom operation amount MB, the arm operation amount MA, the bucket operation amount MT, the target excavation terrain data U obtained from the display controller 28, the bucket blade edge position data S, and the inclination angles θ1, θ2, and θ3 obtained from the sensor controller 39, and in addition, generates an arm command signal and a bucket command signal, as required. The working unit controller 26 drives the control valve 27 and the intervention valve 27C to control the working unit 2.

The relative position calculation unit 26A obtains the bucket blade edge position data S from the display controller 28, and obtains inclination angles θ1, θ2, and θ3 from the sensor controller 39. The relative position calculation unit 26A obtains a blade edge position Pb, namely, a position of the blade edge 8T of the bucket 8, from the obtained inclination angles θ1, θ2, and θ3.

Based on the blade edge position Pb obtained by the relative position calculation unit 26A and based on the target excavation terrain data U obtained from the display controller 28, the distance calculation unit 26B calculates a distance d, namely, the shortest distance between the blade edge 8T of the bucket 8 and the target excavation terrain 43I. The target excavation terrain 43I is represented by the target excavation terrain data U, which is a portion of the target construction information T. The distance d is a distance between the blade edge position Pb and a position Pu at which a line being orthogonal to the target excavation terrain 43I and passing through the blade edge position Pb intersects with the target excavation terrain data U.

The target excavation terrain 43I is defined in a front-back direction of the upper swing body 3 and obtained from an intersection formed by a plane of the working unit 2, passing through an excavation object position Pdg, and by the target construction information T represented by a plurality of target construction surfaces. More specifically, on the above-described intersection, one or more inflection points in front-back of the excavation object position Pdg of the target construction information T and a line in front-back of the inflection points correspond to the target excavation terrain 43I. In an example illustrated in FIG. 5, two inflection points Pv1 and Pv2 and their front-back line correspond to the target excavation terrain 43I. The excavation object position Pdg is a position of the blade edge 8T of the bucket 8, namely, a point immediately beneath the blade edge position Pb. In this manner, the target excavation terrain 43I is a portion of the target construction information T. The target excavation terrain 43I is generated by the display controller 28 illustrated in FIG. 2.

The target speed calculation unit 26C determines a boom target speed Vc_bm, an arm target speed Vc_am, and a bucket target speed Vc_bkt. The boom target speed Vc_bm is a speed of the blade edge 8T when the boom cylinder 10 is driven. The arm target speed Vc_am is a speed of the blade edge 8T when the arm cylinder 11 is driven. The bucket target speed Vc_bkt is a speed of the blade edge 8T when the bucket cylinder 12 is driven. The boom target speed Vc_bm is calculated according to the boom operation amount MB. The arm target speed Vc_am is calculated according to the arm operation amount MA. The bucket target speed Vc_bkt is calculated according to the bucket operation amount MT.

The intervention speed calculation unit 26D obtains a limit speed (boom limit speed) Vcy_bm of the boom 6 based on the distance d between the blade edge 8T of the bucket 8 and the target excavation terrain 43I. As illustrated in FIG. 6, the intervention speed calculation unit 26D obtains a boom limit speed Vcy_bm by subtracting the arm target speed Vc_am and the bucket target speed Vc_bkt from a limit speed Vc_lmt of the overall working unit 2, illustrated in FIG. 1. The limit speed Vc_lmt is a moving speed of the blade edge 8T, acceptable in a direction where the blade edge 8T of the bucket 8 approaches the target excavation terrain 43I.

As illustrated in FIG. 7, the limit speed Vc_lmt takes a negative value when the distance d is positive, and thus, corresponds to a lowering speed when the working unit 2 is lowered. The limit speed Vc_lmt takes a positive value when the distance d is negative, and thus, corresponds to a rising speed when the working unit 2 is raised. A state where the distance d takes a negative value corresponds to a state where the bucket 8 has undermined the target excavation terrain 43I. The limit speed Vc_lmt changes its absolute value such that the absolute value of the speed is decreased as the distance d is decreased, and that, after the distance d turns to a negative value, the absolute value of the speed is increased as the absolute value of the distance d is increased.

The determination unit 26J determines whether the boom limit speed Vcy_bm is going to be corrected. In a case where the determination unit 26J has determined that the boom limit speed Vcy_bm is going to be corrected, the intervention speed modification unit 26F corrects the boom limit speed Vcy_bm and outputs the corrected value. The boom limit speed after correction is represented by Vcy_bm'. In a case where the determination unit 26J has determined that the boom limit speed Vcy_bm is not going to be corrected, the intervention speed modification unit 26F outputs the boom limit speed Vcy_bm without performing correction. The intervention command calculation unit 26E generates a boom command signal CBI based on the boom limit speed Vcy_bm obtained by the intervention speed modification unit 26F. The boom command signal CBI is a command to set an opening size of the intervention valve 27C to be a size needed to allow the pilot pressure required to raise the boom 6 at the boom limit speed Vcy_bm to act on the shuttle valve 51. The boom command signal CBI is a current value corresponding to the boom command speed in an embodiment.

Figure 8:
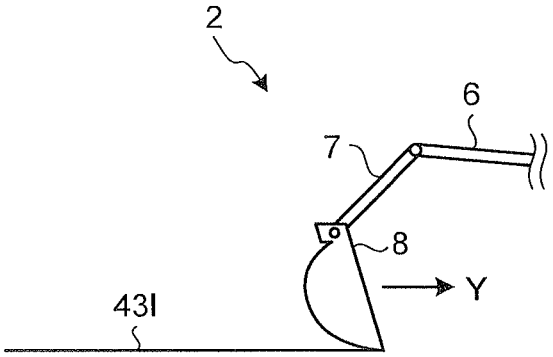
FIG. 8 is a diagram illustrating a relationship between the bucket and the target excavation terrain.
Figure 9:
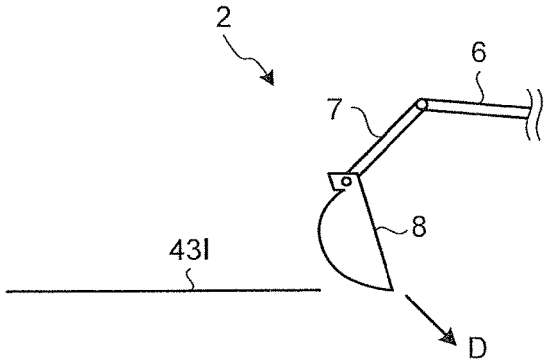
FIG. 9 is a diagram illustrating a relationship between the bucket and the target excavation terrain.

Each of FIGS. 8 and 9 is a diagram illustrating a relationship between the bucket 8 and the target excavation terrain 43I. As described above, intervention control is control of moving the bucket 8 such that the bucket 8 may not undermine the target excavation terrain 43I. In a case where the working unit controller 26 has executed intervention control, when the bucket 8 is about to undermine the target excavation terrain 43I, the working unit controller 26 executes boom intervention control.

As illustrated in FIG. 8, intervention control is executed in a case where the bucket 8 exists above the target excavation terrain 43I. As illustrated in FIG. 9, intervention control is not executed when the bucket 8 has moved, in the arrow Y direction illustrated in FIG. 8, out of a region in which the target excavation terrain 43I exists, to enter a region in which the target excavation terrain 43I does not exist. In short, when the bucket 8 leaves the region in which the target excavation terrain 43I exists, intervention control becomes unnecessary. The target excavation terrain 43I is a portion of the target construction information T, and thus, in a case where the target construction information T does not exist, there is a region in which the target excavation terrain 43I does not exist.

In some cases, an operator of the excavator 100 is executing operation to move the working unit 2 and the bucket 8 downwardly when the working unit controller 26 is executing intervention control. In this case, as illustrated in FIG. 9, when the intervention control is released in a timing when the bucket 8 leaves the region in which the target excavation terrain 43I exists, the bucket 8 might suddenly move in a direction indicated by the arrow D in FIG. 9. This sudden movement might give the operator a sense of discomfort.

Figure 10:
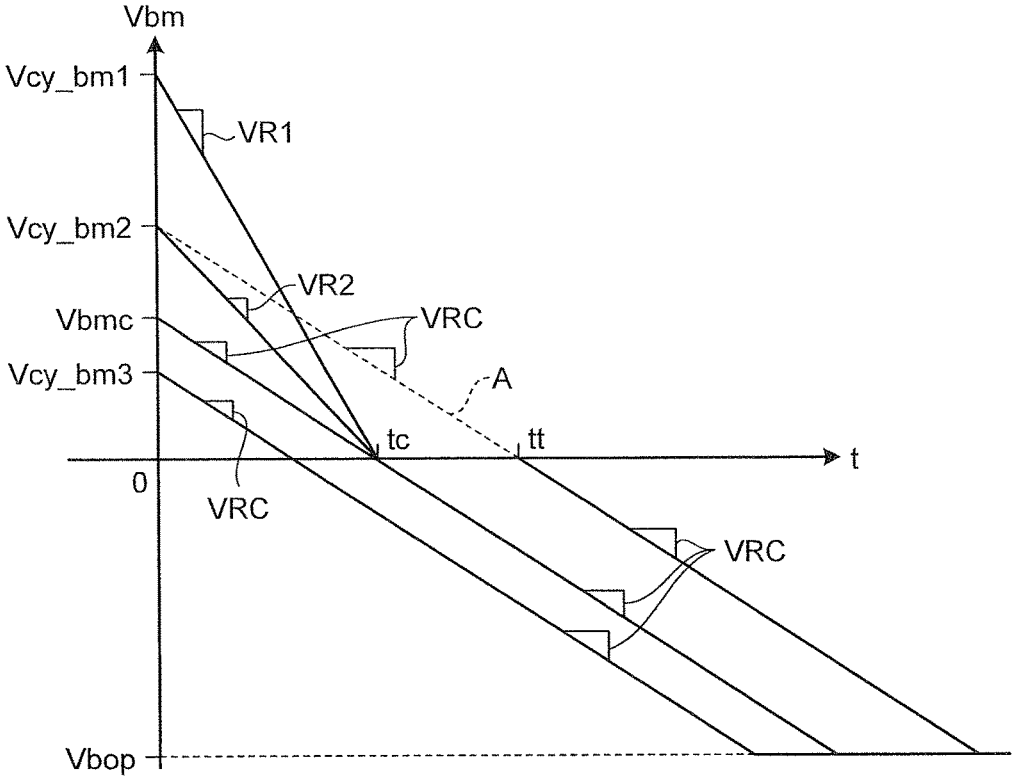
FIG. 10 is a diagram illustrating a relationship between a boom speed, namely, a speed at which the boom operates, and time.

FIG. 10 is a diagram illustrating a relationship between the boom speed Vbm, namely, a speed at which the boom 6 operates, and time t. The vertical axis in FIG. 10 represents the boom speed Vbm, and the horizontal axis represents the time t. The boom speed Vbm, when it takes a positive value, represents a rising speed, namely the speed at which the boom 6 is raised. The boom speed Vbm, when it takes a negative value, represents a lowering speed, namely the speed at which the boom 6 is lowered. Since the boom 6 is a portion of the working unit 2, the boom speed Vbm is a speed of the working unit 2. Accordingly, the rising speed of the boom 6 corresponds to the rising speed of the working unit 2; the lowering speed of the boom 6 corresponds to the lowering speed of the working unit 2. In an embodiment, each of the rising speed and the lowering speed of the working unit 2 is referred to as a moving speed of the working unit 2. The moving speed of the working unit 2 takes a positive value when the working unit 2 is raised. The moving speed of the working unit 2 takes a negative value when the working unit 2 is lowered.

In an embodiment, in a case where the bucket 8 leaves the region in which the target excavation terrain 43I exists, that is, in a case where boom intervention control becomes unnecessary, the working unit controller 26 decreases the speed of the working unit 2, more specifically, decreases the boom speed Vbm of the boom 6 along the elapse of the time t, to be the boom speed Vbop determined by operation by an operator of the excavator 100. In an example illustrated in FIG. 10, the working unit controller 26 decreases the boom speed Vbm at a prescribed change rate VRC indicated by the broken line A to be the boom speed Vbop, from the timing in which boom intervention control becomes unnecessary. The timing in which the boom intervention control becomes unnecessary is a timing of switching between intervention control toward the working unit 2 and control of the working unit 2 based on an operation command from the operation device 25.

The change rate VRC is a value obtained by dividing the amount of change up to the point at which the boom speed Vbm becomes zero in the timing in which the intervention control, or boom intervention control in this example, becomes unnecessary, by the time taken before the boom speed Vbm becomes zero in the timing in which the boom intervention control becomes unnecessary. When the boom speed Vbm in the timing in which boom intervention control becomes unnecessary is defined as a boom limit speed Vcy_bm2, and when the time taken before the boom speed Vbm becomes zero is defined as t=tt, the change rate can be obtained by Formula (1). The timing in which the boom intervention control becomes unnecessary is the timing of t=0 in an example illustrated in FIG. 10. Since the boom limit speed Vcy_bm2 is a positive value, the change rate VRC obtained from Formula (1) is a negative value.

$$VRC=(0-Vcy_bm2)/(tt-0) \quad (1)$$

In a case where the boom 6 is raised, namely, in a case where the boom speed Vbm is positive, the rising speed is decreased when the boom speed Vbm is changed at the change rate VRC. Accordingly, the change rate VRC indicates a decrease rate of the rising speed. In a case where the boom 6 is lowered, namely, in a case where the boom speed Vbm is negative, the lowering speed is increased when the boom speed Vbm is changed at the change rate VRC. Accordingly, the change rate VRC indicates an increase rate of the lowering speed.

During execution of boom intervention control and operation by an operator of lowering the boom 6, when the bucket 8 leaves the region in which the target excavation terrain 43I exists, the boom 6 starts to operate, in that timing, in a boom speed Vbop indicated by the operator. When the bucket 8 leaves the region in which the target excavation terrain 43I exists, during execution of boom intervention control, control is switched from the boom intervention control to the control of the working unit 2 based on an operation command from the operation device 25.

As a result of switching to the control of the working unit 2 based on the operation command from the operation device 25, the boom 6 is suddenly lowered, which might give a sense of discomfort to the operator. In an embodiment, when boom intervention control becomes unnecessary, the working unit controller 26 decreases the boom speed Vbm from the timing in which the boom intervention control becomes unnecessary, at a prescribed change rate VRC, to be a boom speed Vbop indicated by the operator. With this processing, during execution of boom intervention control and during operation by the operator of lowering the boom 6, when the bucket 8 leaves the region in which the target excavation terrain 43I exists and the boom intervention control becomes unnecessary, the boom speed Vbm changes gradually, from the boom limit speed Vcy_bm2, up to the boom speed Vbop indicated by the operator. As a result, the sudden lowering of the boom 6 would be alleviated, making it possible to reduce the sense of discomfort felt by the operator.

Figure 11:
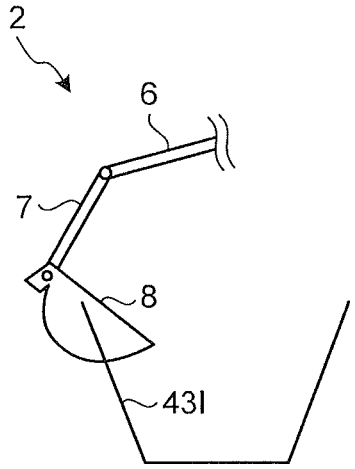
FIG. 11 is a diagram illustrating a relationship between the bucket and the target excavation terrain.
Figure 12:
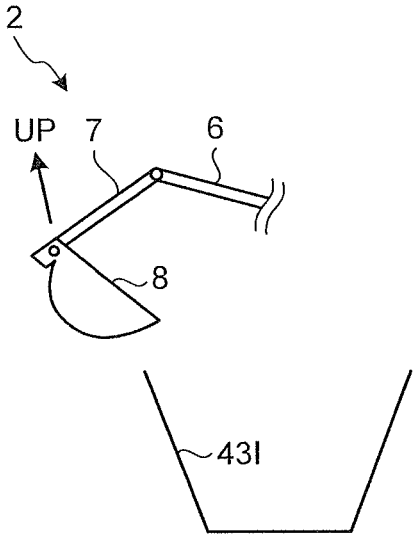
FIG. 12 is a diagram illustrating a relationship between the bucket and the target excavation terrain.

FIGS. 11 and 12 are diagrams each illustrating a relationship between the bucket 8 and the target excavation terrain 43I. When an operator of the excavator 100 suddenly operates the bucket 8 or causes the upper swing body 3 to swing during execution of intervention control by the working unit controller 26, the boom intervention control might miss the timing, in some cases. In this case, as illustrated in FIG. 11, the bucket 8 might significantly undermine the target excavation terrain 43I. In an embodiment, when a degree of undermining the target excavation terrain 43I by the bucket 8 increases, the speed at which the working unit controller 26 raises the boom 6, in boom intervention control, also increases. In this case, the right operation lever 25R to control raising/lowering of the boom 6 is at a lowering or neutral state.

In boom intervention control when the bucket 8 has significantly undermined the target excavation terrain 43I, the rising speed of the boom 6 becomes relatively high. As illustrated in FIG. 12, when the bucket 8 significantly leaves the region in which the target excavation terrain 43I exists, the intervention control is released. As described above, in a case where the boom intervention control becomes unnecessary, the working unit controller 26 decreases the boom speed Vbm at a prescribed change rate VRC, from the timing in which the boom intervention control becomes unnecessary, namely, from the timing in which the intervention control has been released. In this case, the boom 6 and the bucket 8 continue to be raised (moving in the direction indicated by the arrow UP in FIG. 12) until the boom speed Vbm becomes zero in response to the rising operation or neutral operation of the boom 6, and thus, this movement might give a sense of discomfort to the operator.

A case, in the target excavation terrain 43I illustrated in FIGS. 8 and 9, where the working unit 2 leaves the target excavation terrain 43I when the working unit 2 is operated toward the excavator 100 side will be discussed. In this work, there is a case where an operator operates the working unit 2 while the working unit controller 26 is executing boom intervention control. In this case, when the bucket 8 leaves the region in which the target excavation terrain 43I exists, intervention control is released. Under this condition, the operator normally operates the boom 6 downwardly. In response to this operation, boom intervention control works to cause the boom 6 and the bucket 8 to be raised continuously until the boom speed Vbm becomes zero. This operation might give a sense of discomfort to the operator.

As described above, in a case where the boom intervention control becomes unnecessary, the working unit controller 26 decreases the boom speed Vbm in the timing in which the boom intervention control becomes unnecessary, at a prescribed change rate VRC from the boom limit speed Vcy_bm. In a case where the rising speed of the boom 6 is high, this would generate a phenomenon that the boom 6 and the bucket 8 continue to be raised as described above. To cope with this, the working unit controller 26 changes the decrease rate of the rising speed of the working unit 2, more specifically, the boom 6, in the timing in which boom intervention control becomes unnecessary.

Specifically, the intervention speed calculation unit 26D of the working unit controller illustrated in FIG. 4 obtains the boom limit speed Vcy_bm. Next, the determination unit 26J of the working unit controller 26 illustrated in FIG. 4 compares the rising speed of the working unit 2, or the boom limit speed Vcy_bm obtained by the intervention speed calculation unit 26D in the present example, with a threshold Vbmc, in the timing in which boom intervention control becomes unnecessary. In a case where the determination unit 26J has determined that the boom limit speed Vcy_bm is the threshold Vbmc or above, the intervention speed modification unit 26F of the control unit 26CNT obtains a boom limit speed Vcy_bm' after correction, while setting the decrease rate of the rising speed to a value of a case where the rising speed in the timing in which boom intervention control becomes unnecessary is the threshold Vbmc, or to a higher value, and outputs the value to the intervention command calculation unit 26E of the control unit 26CNT. The boom limit speed Vcy_bm being the threshold Vbmc or above means that the absolute value of the boom limit speed Vcy_bm is the absolute value or a higher value, of the threshold Vbmc.

The intervention command calculation unit 26E of the control unit 26CNT generates a boom command signal CBI using the boom limit speed Vcy_bm' after correction, and controls the intervention valve 27C. With this processing, the working unit controller 26 changes the rising speed of the boom 6. In a case where the determination unit 26J has determined that the boom limit speed Vcy_bm is below the threshold Vbmc, the intervention command calculation unit 26E generates a boom command signal CBI using the boom limit speed Vcy_bm obtained by the intervention speed calculation unit 26D, and controls the intervention valve 27C.

The decrease rate of the rising speed is the change rate of the boom speed Vbm when the boom 6 is raised. In an embodiment, the decrease rate of the rising speed when the rising speed at t=0 in FIG. 10 is the threshold Vbmc corresponds to VRC. The timing in which the boom intervention control becomes unnecessary is t=0. A case where the rising speed in the timing in which the boom intervention control becomes unnecessary is the threshold Vbmc or above corresponds to a case where the boom speed Vbm is the boom limit speed Vcy_bm1, Vcy_bm1. The change rate in a case where the boom speed Vbm is the boom limit speed Vcy_bm1 is VR1. The change rate in a case where the boom speed Vbm is the boom limit speed Vcy_bm2 is VR2. In both cases, the change rate is the change rate VRC or above. In this case, the absolute value of each of the change rates VR1 and VR2 is the absolute value of the change rate VRC or the value above this absolute value.

The change rate for a case where the rising speed in the timing in which the boom intervention control becomes unnecessary is the threshold Vbmc or above is a value obtained by dividing the rising speed in the timing in which the boom intervention control becomes unnecessary, namely, the threshold Vbmc as a positive value, by the time tc, namely, the time taken before the boom speed Vbm becomes zero. When the change rate is great, rising of the boom 6 is promptly stopped when the boom intervention control becomes unnecessary. However, this causes the change in the boom speed Vbm to become sudden, leading to generation of impact or a sense of discomfort for the operator. To cope with this, the time tc taken to obtain the change rate for a case where the rising speed in the timing in which the boom intervention control becomes unnecessary is the threshold Vbmc or above is set to within a range in which continuation of rising of the boom 6 and the bucket 8 can be suppressed and the change in the boom speed Vbm cannot be too sudden. In an embodiment, the time tc is determined, for example, by sensory evaluation by the operator, although the method to determine this time tc is not limited to this method. In sensory evaluation by the operator, the time tc is defined from a standard determined by operation of the operator. Alternatively, the time tc may be determined by mass of the working unit 2, not by sensory evaluation by the operator.

The time tc is stored in the storage unit 26M of the working unit controller 26 illustrated in FIG. 2. In an embodiment, the time tc is a prescribed value. Accordingly, the change rate takes different values depending on the rising speed in the timing in which the boom intervention control becomes unnecessary. More specifically, when the rising speed in the timing in which the boom intervention control becomes unnecessary is increased, the intervention speed calculation unit 26D of the control unit 26CNT increases the change rate, namely, the decrease rate of the rising speed. The higher the rising speed in a case where boom intervention control becomes unnecessary, the longer the time during which the boom 6 continues to be raised after the boom intervention control becomes unnecessary. By increasing the decrease rate of the rising speed along with increasing rising speed in the timing in which the boom intervention control becomes unnecessary, it is possible to promptly stop the rising of the boom 6 after the boom intervention control becomes unnecessary.

Although the time tc is a fixed prescribed value in an embodiment, it is allowable to configure such that the time tc can be changed. For example, it is allowable to configure such that a setting screen of the time tc is displayed on the display unit 29 illustrated in FIG. 2 and the operator changes the time tc from the setting screen. It is also allowable to configure such that the intervention speed calculation unit 26D changes the time tc depending on working environment. For example, in a case where the excavator 100 works in an environment having a structure above the working unit 2, information on this environment can be input by the operator into the working unit controller 26. The intervention speed calculation unit 26D obtains the information that there is a structure above and in response to this, sets the time tc to the time shorter than the current setting. With this processing, the working unit controller 26 can more promptly stop rising of the boom 6 after the boom intervention control becomes unnecessary, making it possible to suppress interference between the structure above the working unit 2 with the working unit 2.

In a case where the rising speed in the timing in which the boom intervention control becomes unnecessary is below the threshold Vbmc, the intervention speed calculation unit 26D of the control unit 26CNT sets the change rate, namely, the decrease rate of the rising speed to a prescribed value VRC, regardless of the magnitude of the rising speed in the timing in which boom intervention control becomes unnecessary. In the case where the rising speed in the timing in which boom intervention control becomes unnecessary is below the threshold Vbmc, the time during which the boom 6 continues to be raised after the boom intervention control becomes unnecessary would be short, and thus, this setting would be allowable. Accordingly, a sudden change in the boom speed Vbm is suppressed by setting the decrease rate of the rising speed to a prescribed value VRC.

In a case where the boom 6 is lowered, for example, by an operation command from the operation device 25, the intervention speed calculation unit 26D of the control unit 26CNT sets the speed for the time when the boom 6 is lowered, namely, the change rate (increase rate) of a negative boom speed Vbm to a prescribed value. In a case where the operation device 25 includes an electric operation lever, the operation command to lower the boom 6 is generated by the working unit controller 26 illustrated in FIG. 2.

In an embodiment, the change rate (increase rate) of the negative boom speed Vbm corresponds to a value when the rising speed in the timing in which the boom intervention control becomes unnecessary is the threshold Vbmc, that is, corresponds to the VRC. By setting the change rate of a speed for the time when the boom 6 is lowered to a prescribed value, it is possible to suppress a sudden lowering of the boom 6 when the intervention control is released during operation of lowering the boom 6 by the operator. A desirable magnitude of the change rate of the speed for the time when the boom 6 is lowered, for example, would be a magnitude whereby a sudden lowering of the boom 6 can be suppressed to an allowable range in a case where the operator performs operation to lower the boom 6 at a maximum boom limit speed Vcy_bm (boom limit speed Vcy_bm1 in an example illustrated in FIG. 8).

The timing in which intervention control including the boom intervention control becomes unnecessary may be the time at which the intervention control becomes unnecessary, or may be the time before or after the time at which the intervention control becomes unnecessary by a several cycles of control by the working unit controller 26. Meanwhile, the determination unit 26J preliminarily determines a timing in which the bucket 8 move to a position in a region that the target excavation terrain 43I is going to leave, namely, the timing in which intervention control becomes unnecessary. It is allowable to configure such that the intervention speed modification unit 26F executes control of gradually decreasing the rising speed of the boom 6 at the timing in which intervention control becomes unnecessary, obtained by the determination unit 26J.

A method of preliminarily determining the timing in which intervention control becomes unnecessary is as follows. The determination unit 26J obtains the speed of the bucket 8 of the working unit 2 from the operation speeds of the boom cylinder 10, the arm cylinder 11, and the bucket cylinder 12. The determination unit 26J obtains a timing in which the bucket 8 moves to a position in a region that the target excavation terrain 43I is going to leave, using the speed of the bucket 8 obtained, the target excavation terrain data U and the bucket blade edge position data S obtained from the display controller 28.

<Control Method of Work Machine According to Embodiments>

Figure 13:
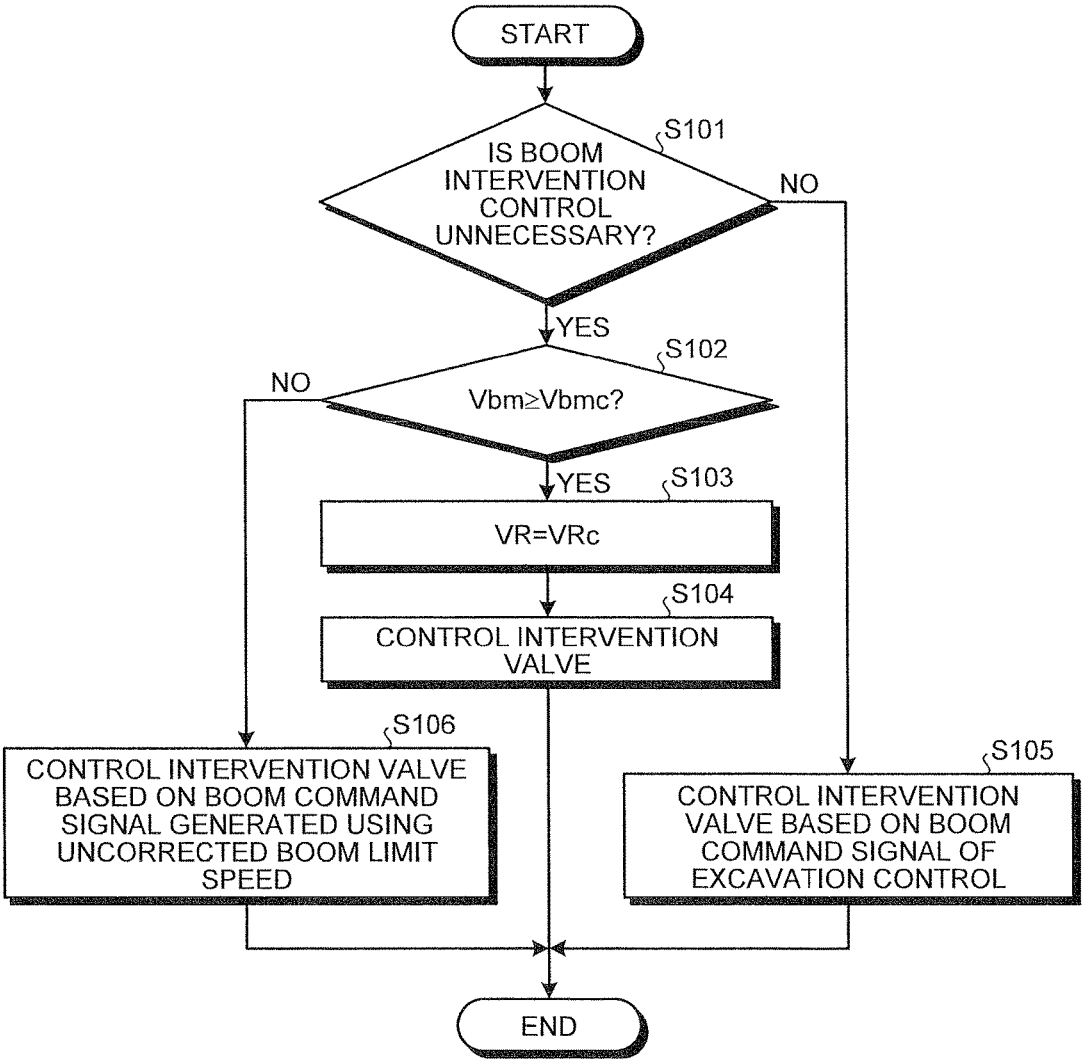
FIG. 13 is a flowchart illustrating a work machine control method according to an embodiment.

FIG. 13 is a flowchart illustrating a work machine control method according to an embodiment. The work machine control method according to an embodiment is achieved by the working unit controller 26. At step S101, the determination unit 26J of the working unit controller 26 illustrated in FIG. 4 determines whether boom intervention control is unnecessary. In a case where the determination unit 26J has determined that boom intervention control is unnecessary (step S101, Yes), the intervention speed modification unit 26F compares, at step S102, the boom limit speed Vcy_bm in the timing of determination of step S101, namely, the timing in which intervention control becomes unnecessary, with the threshold Vbmc.

At step S102, in a case where the boom limit speed Vcy_bm has been determined to be the threshold Vbmc or above (step S102, Yes), the intervention speed modification unit 26F of the control unit 26CNT of the working unit controller 26 sets, at step S103, the change rate VR, namely, the decrease rate of the rising speed of the boom 6, to the change rate VRC for the case of the threshold Vbmc. Subsequently, the intervention speed modification unit 26F obtains the boom limit speed Vcy_bm' after correction, based on the set change rate VR, and outputs the value to the intervention command calculation unit 26E of the control unit 26CNT. In the setting of the change rate VR, the intervention speed modification unit 26F obtains the boom limit speed Vcy_bm in the timing in which intervention control becomes unnecessary, from the intervention speed calculation unit 26D, and together with this, obtains the time tc from the storage unit 26M and obtains the change rate VR. The change rate VR is a value obtained by dividing the amount of change until the boom limit speed Vcy_bm in the timing in which intervention control becomes unnecessary becomes zero, by the time tc, namely the value of −Vcy_bm/tc. The boom limit speed Vcy_bm in the timing in which intervention control becomes unnecessary can be obtained by the intervention speed calculation unit 26D.

At step S104, the intervention command calculation unit 26E of the working unit controller 26 generates a boom command signal CBI from the boom limit speed Vcy_bm' after correction, obtained by the intervention speed modification unit 26F, and outputs the signal to the intervention valve 27C, thereby controlling the intervention valve 27C.

Back to step S101, in a case where the determination unit 26J has determined that boom intervention control is necessary (step S101, No), the control unit 26CNT controls, at step S105, the intervention valve 27C based on the boom command signal CBI of the intervention control. Back to step S102, in a case where the boom limit speed Vcy_bm is determined to be below the threshold Vbmc, the control unit 26CNT generates, at step S106, a boom command signal CBI using the uncorrected boom limit speed Vcy_bm, and controls the intervention valve 27C.

At step S103, the intervention command calculation unit 26E may obtain the change rate VR using the boom speed Vbm in the timing in which intervention control becomes unnecessary, instead of using the boom limit speed Vcy_bm in the timing in which intervention control becomes unnecessary. The boom speed Vbm can be obtained, for example, from a speed in which the boom cylinder 10 extends. The speed in which the boom cylinder 10 extends can be obtained from a detection value of the first stroke sensor 16.

<Switching from Manual Operation to Intervention Control>

The working unit controller 26 has changed the change rate of the moving speed of the working unit 2 in the timing in which intervention control is switched to manual control. Configuration is not limited to this control and may be such that the working unit controller 26 changes the change rate of the moving speed of the working unit 2 in a timing in which manual control is switched to intervention control.

Figure 14:
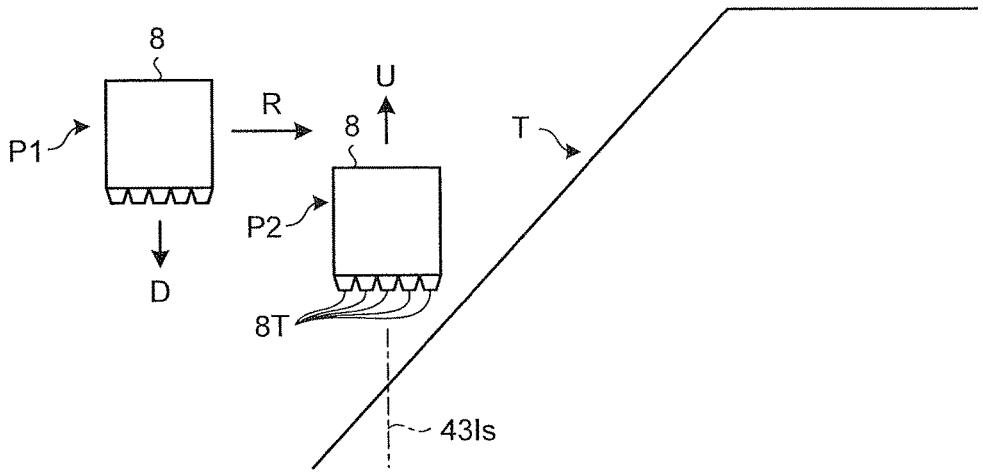
FIG. 14 is a diagram for illustrating an exemplary case in which manual operation is switched to intervention control.
Figure 15:
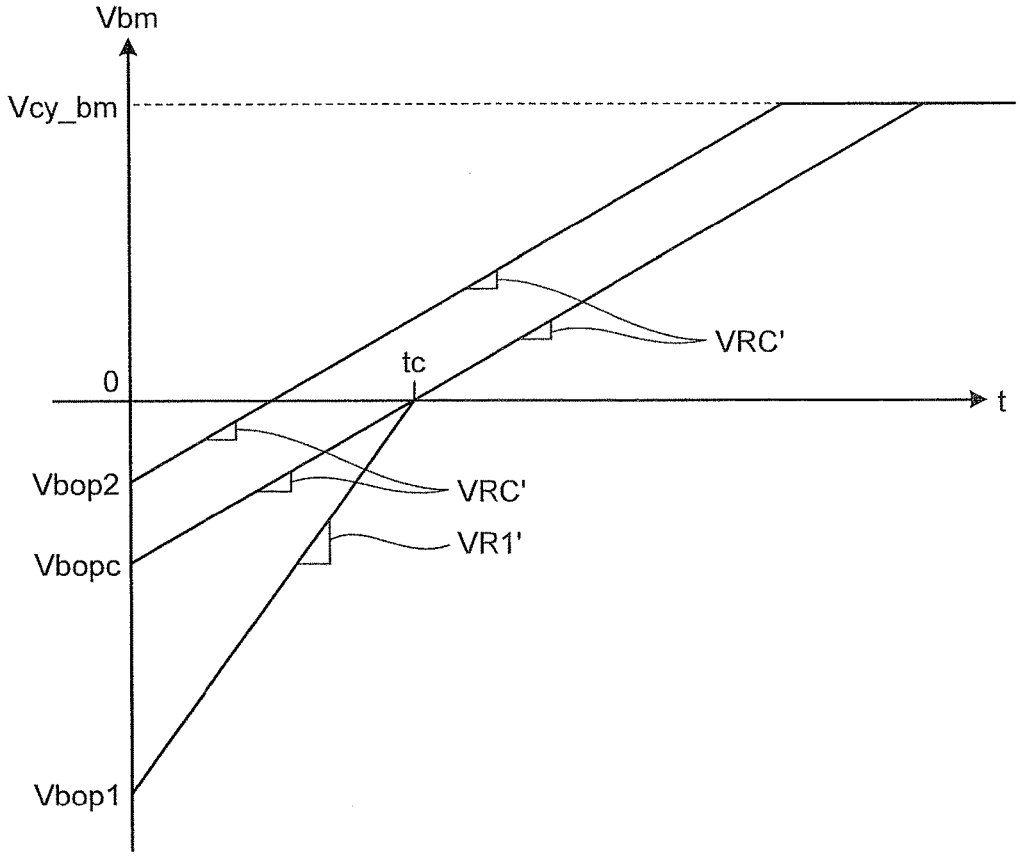
FIG. 15 is a diagram illustrating a relationship between a boom speed at which the boom operates, and time.

FIG. 14 is a diagram for illustrating an exemplary case in which manual operation is switched to intervention control. FIG. 15 is a diagram illustrating a relationship between a boom speed at which the boom operates, and time. In some cases, the bucket 8 is positioned above a target excavation terrain 43Is on a slope when an operator of the excavator 100 is lowering the bucket 8 while causing the upper swing body 3 to swing by manual operation. In this case, the working unit controller 26 executes intervention control and raises the bucket 8. This is an example in which manual operation is switched to intervention control.

In an example illustrated in FIG. 14, the bucket 8 moves in the arrow D direction by manual operation of lowering, and the bucket 8 moves in the arrow R direction by manual operation of swing, above the region in which the target construction information T does not exist. By swing operation, the bucket 8 moves from a position P1 above the region in which the target construction information T does not exist, to a position P2 above the target construction information T. Subsequently, the bucket 8 moves in the arrow U direction in FIG. 14 by intervention control executed by the working unit controller 26 based on target excavation terrain information 43Is determined based on the target construction information T and the position of the blade edge 8T of the bucket 8. In an example illustrated in FIG. 15, the timing of switching between control by manual operation, namely, control of the working unit 2 based on an operation command from the operation device 25, and intervention control toward the working unit 2, corresponds to the timing in which the boom intervention control becomes necessary. This timing corresponds to time t=0.

The change rate VRC' is a value obtained by dividing the amount of change up to the time when the boom speed Vbm becomes zero in the timing when the intervention control, or boom intervention control in this example, becomes necessary, by the time taken before the boom speed Vbm becomes zero in the timing in which the boom intervention control becomes unnecessary. When the boom speed Vbm in the timing in which the boom intervention control becomes unnecessary is defined as a manual operation speed Vbopc, and when the time taken before the boom speed Vbm becomes zero is defined as t=tc, the change rate can be obtained by Formula (2). The timing in which the boom intervention control becomes unnecessary is the timing of t=0 in an example illustrated in FIG. 10. Since the manual operation speed Vbopc is a negative value, the change rate VRC' obtained from Formula (2) is a positive value.

$$VRC'=(0-Vbopc)/(tc-0) \quad (2)$$

In a case where the boom 6 is lowered, namely, in a case where the boom speed Vbm is negative, the lowering speed is decreased when the boom speed Vbm is changed at the change rate VRC'. Accordingly, the change rate VRC' indicates the decrease rate of the lowering speed. In a case where the boom 6 is raised, namely, in a case where the boom speed Vbm is positive, the rising speed is increased when the boom speed Vbm is changed at the change rate VRC'. Accordingly, the change rate VRC' indicates the increase rate of the rising speed.

When the bucket 8 is positioned above the region in which the target excavation terrain 43Is exists during manual operation of lowering and swing by the operator, boom intervention control becomes necessary in that timing. Accordingly, the working unit controller 26 executes boom intervention control. In this case, the working unit controller 26 sets the boom speed Vbm to the boom limit speed Vcy_bm2.

As a result of switching from control by manual operation, namely, control of the working unit 2 based on the operation command from the operation device 25, to the boom intervention control, the boom 6 is suddenly raised and this might generate impact or give a sense of discomfort to the operator. In an embodiment, when boom intervention control becomes necessary, the working unit controller 26 decreases the boom speed Vbm, in this case, decreases the lowering speed, to zero, at a prescribed change rate VRC' from the timing in which the boom intervention control becomes necessary. Thereafter, the working unit controller 26 increases the boom speed Vbm, in this case, increases the rising speed at a prescribed rate so as to be the boom limit speed Vcy_bm2.

With this processing, when boom intervention control becomes necessary when the bucket 8 has entered the region in which the target excavation terrain 43Is exits during control by manual operation, the boom speed Vbm changes from the lowering speed at entering, up to the boom limit speed Vcy_bm2. As a result, the sudden rising of the boom 6 would be alleviated, making it possible to reduce the impact and the sense of discomfort felt by the operator.

When boom intervention control becomes necessary, the working unit controller 26 decreases the boom speed Vbm at a prescribed change rate VRC' from the lowering speed in the timing in which the boom intervention control becomes necessary. When the lowering speed of the boom 6 is high in this case, this generates a phenomenon in which the boom 6 and the bucket 8 continue to be lowered regardless of execution of boom intervention control. As a result, it is possible that the operator might feel a sense of discomfort and the bucket 8 might undermine the target excavation terrain 43Is. To cope with this, the working unit controller 26 changes the decrease rate of the lowering speed of the working unit 2, more specifically, the boom 6, in the timing in which boom intervention control becomes necessary.

Specifically, the intervention speed calculation unit 26D of the working unit controller illustrated in FIG. 4 obtains the lowering speed of the boom 6 in the timing in which boom intervention control becomes necessary. Next, the determination unit 26J of the working unit controller 26 illustrated in FIG. 4 compares the lowering speed of the working unit 2, or the lowering speed of the boom 6 obtained by the intervention speed calculation unit 26D in the present example, with a threshold Vbopc, in the timing in which boom intervention control becomes necessary.

In a case where the determination unit 26J has determined that the lowering speed of the boom 6 is the threshold Vbopc or below, the intervention speed modification unit 26F of the control unit 26CNT obtains a boom limit speed Vcy_bm' after correction, while setting the decrease rate of the lowering speed of the boom 6 to a value for a case where the lowering speed in the timing in which boom intervention control becomes necessary is the threshold Vbopc, or to a lower value, and outputs the value to the intervention command calculation unit 26E of the control unit 26CNT. The lowering speed of the boom 6 being the threshold Vbopc or below means that the absolute value of the lowering speed of the boom 6 is the absolute value or a higher value, of the threshold Vbopc.

The intervention command calculation unit 26E of the control unit 26CNT generates a boom command signal CBI using the boom limit speed Vcy_bm' after correction, and controls the intervention valve 27C. With this processing, the working unit controller 26 changes the lowering speed of the boom 6. In a case where the determination unit 26J has determined that the boom limit speed Vcy_bm is above the threshold Vbopc, the intervention command calculation unit 26E generates a boom command signal CBI using the boom limit speed Vcy_bm obtained by the intervention speed calculation unit 26D, and controls the intervention valve 27C.

The decrease rate of the lowering speed is the change rate of the boom speed Vbm when the boom 6 is lowered. In an embodiment, the decrease rate of the lowering speed is VRC' in a case where the lowering speed of the boom 6 at time t=0 as illustrated in FIG. 15 is the threshold Vbopc. The timing in which the boom intervention control becomes necessary is t=0. A case where the lowering speed in the timing in which boom intervention control becomes necessary is the threshold Vbopc or below is a case where the boom speed Vbm is a lowering speed Vbop1. The change rate in a case where the boom speed Vbm is the lowering speed Vcop1 is VR1', which is the same as or lower than the change rate VRC. In this case, the absolute value of the lowering speed Vbop1 is the absolute value of the threshold Vbopc, or above. The absolute value of the change rate VR1' is the absolute value of the change rate VRC, or above.

The change rate for a case where the lowering speed in the timing in which the boom intervention control becomes necessary is below the threshold Vbopc is a value obtained by dividing the lowering speed in a timing in which the boom intervention control becomes necessary, namely, the threshold Vbopc as a negative value, by the time tc, namely the time taken before the boom speed Vbm becomes zero.

When the change rate is great, lowering of the boom 6 is promptly stopped when the boom intervention control becomes necessary. However, this causes the change in the boom speed Vbm to become sudden, leading to generation of impact or a sense of discomfort for the operator. To cope with this, the time tc used to obtain the change rate for a case where the lowering speed in the timing in which the boom intervention control becomes necessary is the threshold Vbopc or below is set to be within a range in which continuation of lowering of the boom 6 and the bucket 8 can be suppressed and the change in the boom speed Vbm cannot be too sudden. The method to determine the time tc is as described above.

The time tc is stored in the storage unit 26M of the working unit controller 26 illustrated in FIG. 2. In an embodiment, the time tc is a prescribed value. Accordingly, the change rate takes different values depending on the rising speed in the timing in which the boom intervention control becomes necessary. More specifically, when the lowering speed in the timing in which the boom intervention control becomes necessary is increased, the intervention speed calculation unit 26D of the control unit 26CNT increases the change rate, namely, the decrease rate of the lowering speed. The higher the lowering speed in a case where boom intervention control becomes necessary, the longer the time during which the boom 6 continues to be lowered after the boom intervention control becomes necessary. By increasing the decrease rate of the lowering speed along with increasing lowering speed in the timing in which the boom intervention control becomes necessary, it is possible to promptly stop the lowering of the boom 6 after the boom intervention control becomes necessary. As a result, it is possible to reduce the possibility that the operator feels a sense of discomfort and the bucket 8 undermines the target excavation terrain 43Is.

In a case where the lowering speed in the timing in which the boom intervention control becomes necessary is above the threshold Vbopc, for example, equal to the lowering speed Vbop2 in FIG. 15, the intervention speed calculation unit 26D of the control unit 26CNT sets the change rate, namely, the decrease rate of the lowering speed to a prescribed value VRC' regardless of the magnitude of the lowering speed in the timing in which boom intervention control becomes necessary. In the case where the lowering speed in the timing in which boom intervention control becomes necessary is above the threshold Vbopc, the time during which the boom 6 continues to be lowered after the boom intervention control becomes necessary would be short, and thus, this setting would be allowable. Accordingly, a sudden change in the boom speed Vbm is suppressed by setting the decrease rate of the lowering speed to a prescribed value VRC'.

In a case where switching is performed from manual operation for lowering the working unit 2, to the boom intervention control, the change rate (increase rate) of the rising speed of the boom 6, namely, the positive boom speed Vbm, corresponds to a value when the lowering speed in the timing in which boom intervention control becomes necessary is the threshold Vbopc, that is, corresponds to the VRC. In a case where switching is performed from manual operation to lower the working unit 2 to the boom intervention control, by setting the change rate of a speed for the time when the boom 6 is raised, to a prescribed value, it is possible to suppress a sudden raising of the boom 6 when the operation of lowering the boom 6 by the operator is released during execution of boom intervention control.

<Electric Operation Lever>

In an embodiment, the operation device 25 includes a pilot hydraulic pressure-type operation lever. Alternatively, the operation device 25 may include an electric left operation lever 25La and an electric right operation lever 25Ra. In a case where the left operation lever 25La and the right operation lever 25Ra are electric, the operation amount for each is detected by an individual potentiometer. The operation amount of each of the left operation lever 25La and the right operation lever 25Ra, detected by the potentiometer, is obtained by the working unit controller 26. The working unit controller 26 that has detected an operation signal of the electric operation lever executes control that is similar to the case of the pilot hydraulic pressure-type.

As described above, in an embodiment, in a case where the rising speed of the working unit 2 is a threshold or above in a timing in which intervention control becomes unnecessary, a rising speed of the working unit 2 is changed while setting the decrease rate of the rising speed of the working unit to a value for the case where the rising speed in the timing in which intervention control becomes unnecessary is the threshold, or to a higher value. With this processing, in an embodiment, it is possible to relatively increase the decrease rate of the rising speed in a case where the rising speed in the timing in which intervention control becomes unnecessary is relatively high. Accordingly, it is possible to promptly suppress raising of the working unit 2. In this manner, in an embodiment, it is possible to suppress raising of the working unit 2 after intervention control becomes unnecessary. With this configuration, it is possible to suppress the sense of discomfort felt by the operator caused by a condition in which raising of the working unit 2 is not stopped. At the same time, in a case where the excavator 100 operates in an environment where there is an object above the working unit 2, it is possible to decrease the possibility of interference of the object with the working unit 2.

In a case where switching is performed from the control of the working unit 2 based on the operation command from the operation device 25 to the intervention control, when the lowering speed of the working unit 2 is a threshold or below in a timing in which intervention control becomes necessary, the lowering speed of the working unit 2 is changed while setting the decrease rate of the lowering speed of the working unit to a value for the case where the rising speed in the timing in which intervention control becomes unnecessary is the threshold, or to a lower value. With this processing, in an embodiment, it is possible to relatively increase the decrease rate of the lowering speed in a case where the lowering speed in the timing in which intervention control becomes necessary is relatively high. Accordingly, it is possible to promptly suppress lowering of the working unit 2. In this manner, in an embodiment, it is possible to suppress lowering of the working unit 2 after intervention control becomes necessary. With this configuration, it is possible to suppress the sense of discomfort on the operator caused by a condition in which the raising of the working unit 2 is not stopped, and to reduce the possibility that the working unit 2 would undermine the target excavation terrain 43Is.

In this manner, in an embodiment, the change rate of the moving speed of the working unit 2 is changed according to the moving speed of the working unit 2 in the timing of switching between the intervention control toward the working unit 2 and the control of the working unit 2 based on the operation command from the operation device 25. With this configuration, in an embodiment, it is possible to suppress the sense of discomfort felt by the operator caused by the condition that the working unit 2 does not operate in a direction in which the working unit 2 should operate by switched control, at a time of switching between intervention control and control of the working unit 2 based on the operation command from the operation device 25.

Embodiments have been described as above, although the embodiments are not limited by the description. The constituents described above include constituents that could be easily conceived by a person skilled in the art and constituents that are substantially identical or equivalent in scope. Furthermore, it is possible to combine the above-described constituents as appropriate. Furthermore, it is possible to perform at least one of various types of omissions, replacements, and modifications, of the constituents within the scope of the embodiments. For example, although the working unit 2 includes the boom 6, the arm 7, and the bucket 8, attachments to be attached to the working unit 2 are not limited to these, and not limited to the bucket 8. The work machine is only required to include a working unit and is not limited to the excavator 100.

REFERENCE SIGNS LIST

1 VEHICLE MAIN BODY
2 WORKING UNIT
3 UPPER SWING BODY
5 TRAVELING DEVICE
6 BOOM
7 ARM

8 BUCKET
10 BOOM CYLINDER
11 ARM CYLINDER
12 BUCKET CYLINDER
19 POSITION DETECTION DEVICE
23 GLOBAL COORDINATE CALCULATION UNIT
25, 25*a* OPERATION DEVICE
26 WORKING UNIT CONTROLLER
26A RELATIVE POSITION CALCULATION UNIT
26B DISTANCE CALCULATION UNIT
26CNT CONTROL UNIT
26C TARGET SPEED CALCULATION UNIT
26D INTERVENTION SPEED CALCULATION UNIT
26E INTERVENTION COMMAND CALCULATION UNIT
26J DETERMINATION UNIT
26M STORAGE UNIT
26P PROCESSING UNIT
27C INTERVENTION VALVE
27 CONTROL VALVE
28 DISPLAY CONTROLLER
39 SENSOR CONTROLLER
43I TARGET EXCAVATION TERRAIN
51 SHUTTLE VALVE
64, 64A, 64B, 64BK DIRECTIONAL CONTROL VALVE
100 EXCAVATOR
200 CONTROL SYSTEM
300 HYDRAULIC SYSTEM
301, 302 HYDRAULIC CIRCUIT

The invention claimed is:

1. A work machine control device comprising:

wherein the work machine control device is configured to execute intervention control to control a moving speed of a working unit of a work machine based on a distance between the working unit and target excavation terrain, a control unit configured to determine whether the working unit is positioned in a region that the target excavation terrain is going to leave, and configured to switch from the intervention control to control of the working unit based on an operation command from an operation device when the working unit is determined to be positioned in the region, and configured to determine whether the moving speed is a threshold or above at a time of the switching, and configured to change the moving speed such that a decrease rate of the moving speed is set to a decrease rate for a case where the moving speed in the timing of switching is the threshold, or to a higher value when the moving speed is the threshold or above at the time of switching.

2. The work machine control device according to claim 1, wherein the intervention control is control of raising the working unit, the moving speed of the working unit is a rising speed of the working unit, and the control unit is configured to determine whether the rising speed is a threshold or above in the time of switching, and is configured to change the rising speed such that a decrease rate of the rising speed is set to a value for a case where the rising speed in the time of switching is the threshold, or to a higher value in a case where the rising speed is the threshold or above.

3. The work machine control device according to claim 2, wherein the control unit increases the decrease rate when the rising speed in the time of switching is increased.

4. The work machine control device according to claim 3, wherein in a case where the rising speed in the timing of switching is below the threshold, the control unit sets the decrease rate to a predetermined value regardless of a magnitude of the rising speed at the time of switching.

5. The work machine control device according to claim 2, wherein, in a case where the working unit is lowered by an operation command, the control unit sets a change rate of a lowering speed of the working unit to a predetermined value.

6. The work machine control device according to claim 2, wherein the work machine includes a swing body equipped with the working unit.

7. A work machine comprising:

a work machine control device comprising:

wherein the work machine control device is configured to execute intervention control to control a moving speed of a working unit of a work machine based on a distance between the working unit and target excavation terrain, a control unit configured to determine whether the working unit is positioned in a region that the target excavation terrain is going to leave, and configured to switch from the intervention control to control of the working unit based on an operation command from an operation device when the working unit is determined to be positioned in the region, and configured to determine whether the moving speed is a threshold or above at a time of the switching, and configured to change the moving speed such that a decrease rate of the moving speed is set to a decrease rate for a case where the moving speed in the timing of switching is the threshold, or to a higher value when the moving speed is the threshold or above at the time of switching.

8. A control method for a work machine, the control method comprising:

wherein the control method includes executing intervention control to control a moving speed of a working unit of a work machine based on a distance between the working unit and target excavation terrain, determining whether the working unit is positioned in a region that the target excavation terrain is going to leave;

switching from the intervention control to control of the working unit based on an operation command from an operation device when the working unit is determined to be positioned in the region;

determining whether the moving speed is a threshold or above at a time of the switching; and changing the moving speed such that a decrease rate of the moving speed is set to a decrease rate for a case where the moving speed in the timing of switching is the threshold, or to a higher value when the moving speed is the threshold or above at the time of switching.

* * * * *